US011458610B2

(12) United States Patent
Kamiya

(10) Patent No.: US 11,458,610 B2
(45) Date of Patent: Oct. 4, 2022

(54) POWER TOOL

(71) Applicant: MAKITA CORPORATION, Anjo (JP)

(72) Inventor: Takeshi Kamiya, Anjo (JP)

(73) Assignee: MAKITA CORPORATION, Anjo (JP)

( * ) Notice: Subject to any disclaimer, the term of this patent is extended or adjusted under 35 U.S.C. 154(b) by 83 days.

(21) Appl. No.: 16/875,473

(22) Filed: May 15, 2020

(65) Prior Publication Data

US 2020/0406444 A1 Dec. 31, 2020

(30) Foreign Application Priority Data

Jun. 28, 2019 (JP) ..... JP2019-121660

(51) Int. Cl.

| | |
|---|---|
| ***B25F 5/00*** | (2006.01) |
| ***B25F 5/02*** | (2006.01) |
| ***B25D 16/00*** | (2006.01) |
| ***B25B 21/02*** | (2006.01) |
| ***B25B 21/00*** | (2006.01) |

(52) U.S. Cl.

CPC ..... *B25F 5/001* (2013.01); *B25F 5/02* (2013.01); *B25B 21/007* (2013.01); *B25B 21/026* (2013.01); *B25D 16/003* (2013.01); *B25D 16/006* (2013.01); *B25D 2216/0084* (2013.01)

(58) Field of Classification Search

CPC ..... B25F 5/001; B25F 5/02; B25B 21/007; B25B 21/026; B25D 16/003; B25D 16/006; B25D 2216/0084

See application file for complete search history.

(56) References Cited

U.S. PATENT DOCUMENTS

2012/0006575 A1* 1/2012 Hecht ..... B25B 21/00 173/216
2013/0270051 A1* 10/2013 Hecht ..... B25B 21/00 192/38
2017/0157753 A1* 6/2017 Nagasaka ..... B25B 21/023

FOREIGN PATENT DOCUMENTS

JP 2017-100259 A 6/2017

* cited by examiner

*Primary Examiner* — Anna K Kinsaul
*Assistant Examiner* — Daniel Jeremy Leeds
(74) *Attorney, Agent, or Firm* — Oliff PLC

(57) ABSTRACT

Rotation of a spindle relative to a first cam is reduced. A power tool includes a spindle to receive a tip tool and rotatable about a rotation axis, and a vibration mechanism that vibrates the spindle in an axial direction. The spindle has an outer surface including, in a cross section orthogonal to the rotation axis, a first portion at a first distance from the rotation axis, and a second portion at a second distance from the rotation axis. The vibration mechanism includes a first cam surrounding the spindle, and a second cam located behind and in contact with the first cam.

17 Claims, 29 Drawing Sheets

POWER TOOL

CROSS-REFERENCE TO RELATED APPLICATIONS

This application claims the benefit of priority to Japanese Patent Application No. 2019-121660, filed on Jun. 28, 2019, the entire contents of which are hereby incorporated by reference.

BACKGROUND

1. Technical Field

The present invention relates to a power tool.

2. Description of the Background

A known vibration driver drill is described in, for example, Japanese Unexamined Patent Application Publication No. 2017-100259. The vibration driver drill includes a vibration mechanism for vibrating a spindle in an axial direction. The vibration mechanism includes a first cam fixed to the spindle and a second cam located behind the first cam. The spindle rotates with the first cam in contact with the second cam while the second cam is restricted from rotating. This causes the spindle to vibrate in the axial direction.

BRIEF SUMMARY

When the first cam is fixed insufficiently to the spindle, the spindle may rotate relative to the first cam. When the spindle rotates relative to the first cam in contact with the second cam, the first cam may be nonrotatable relative to the second cam. When the first cam is nonrotatable relative to the second cam, the spindle may vibrate insufficiently.

One or more aspects of the present invention are directed to reducing rotation of a spindle relative to a first cam.

A first aspect of the present invention provides a power tool, including:

- a spindle to receive a tip tool and rotatable about a rotation axis, the spindle having an outer surface including
  - a first portion at a first distance from the rotation axis in a cross section orthogonal to the rotation axis, and
  - a second portion at a second distance from the rotation axis in a cross section orthogonal to the rotation axis, the second distance being different from the first distance; and
- a vibration mechanism configured to vibrate the spindle in an axial direction,
  - the vibration mechanism including
  - a first cam surrounding the spindle, and
  - a second cam located behind and in contact with the first cam.

A second aspect of the present invention provides a power tool, including:

- a spindle to receive a tip tool and rotatable about a rotation axis; and
- a vibration mechanism configured to vibrate the spindle in an axial direction, the vibration mechanism including
  - a first cam surrounding the spindle,
    - the first cam including
    - a third portion at a third distance from the rotation axis in a cross section orthogonal to the rotation axis, and

- a fourth portion at a fourth distance from the rotation axis in a cross section orthogonal to the rotation axis, the fourth distance being different from the third distance, and
  - a second cam located behind and in contact with the first cam.

A third aspect of the present invention provides a power tool, including:

- a spindle to receive a tip tool and rotatable about a rotation axis; and
- a vibration mechanism configured to vibrate the spindle in an axial direction, the vibration mechanism including
  - a first cam surrounding the spindle,
  - an engagement member located between the spindle and the first cam, and
  - a second cam located behind and in contact with the first cam.

The above aspects of the present invention reduce rotation of the spindle relative to the first cam.

DETAILED DESCRIPTION

Although one or more embodiments of the present invention will now be described with reference to the drawings, the present invention is not limited to the embodiments. The components in the embodiments described below may be combined as appropriate. One or qmore components may be eliminated.

In the embodiments, the positional relationships between the components will be described using the directional terms such as right, left, front, rear, up, and down. The terms indicate relative positions or directions with respect to the center of a power tool 1. The power tool 1 according to the embodiments is a vibration driver drill.

In the embodiments, a direction parallel to a rotation axis AX of a spindle 61 is referred to as an axial direction for convenience. A direction about the rotation axis AX is referred to as a circumferential direction or circumferentially for convenience. A direction radial from the rotation axis AX is referred to as a radial direction or radially for convenience. A position nearer the rotation axis AX in the radial direction, or a radial direction toward the rotation axis AX, is referred to as radially inside or radially inward for convenience. A position farther from the rotation axis AX in the radial direction, or a radial direction away from the rotation axis AX, is referred to as radially outside or radially outward for convenience.

The rotation axis AX extends in the front-rear direction. The axial direction corresponds to the front-rear direction.

First Embodiment

Overview of Power Tool

Figure 1:
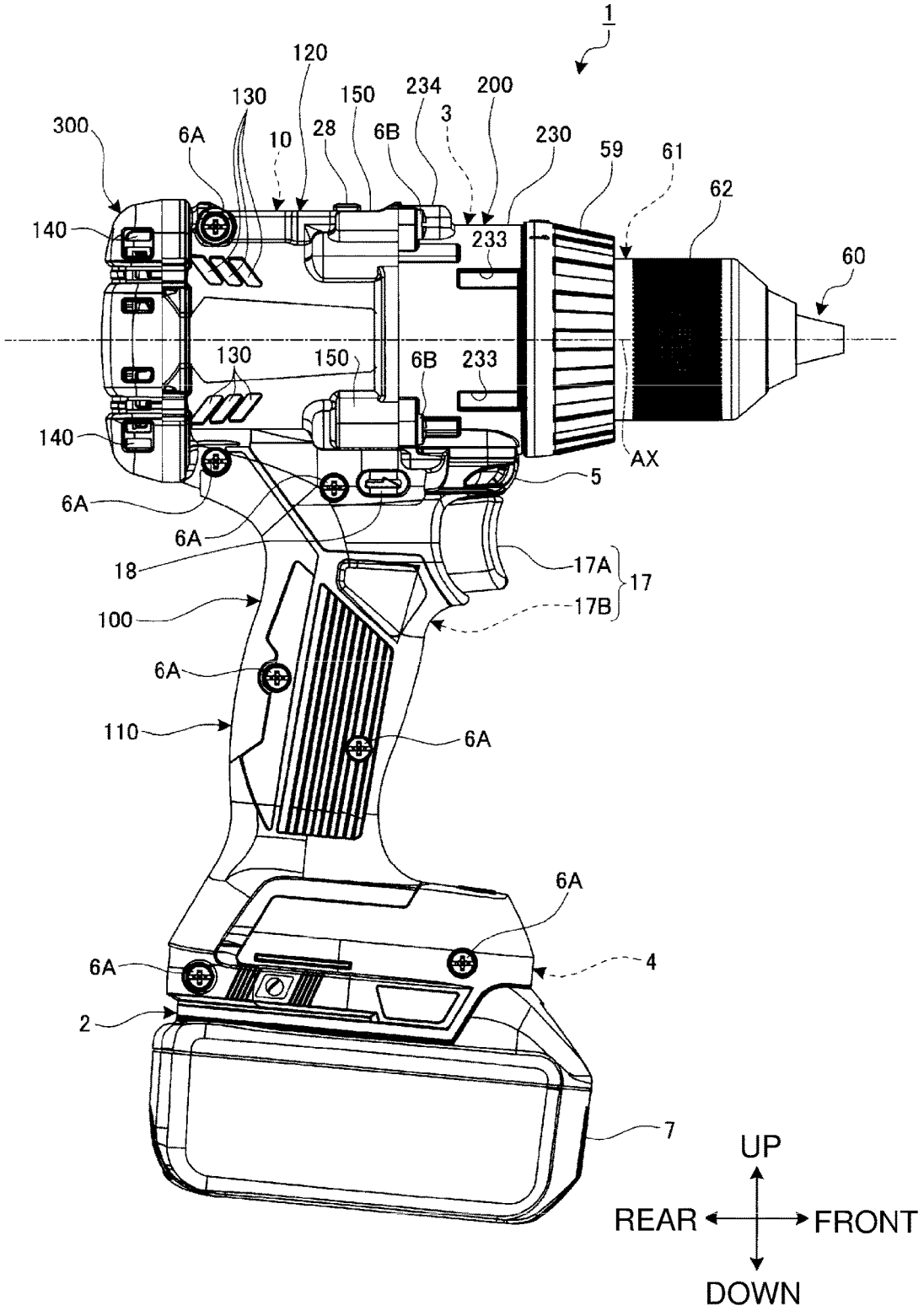
FIG. 1 is a side view of a power tool according to a first embodiment.
Figure 2:
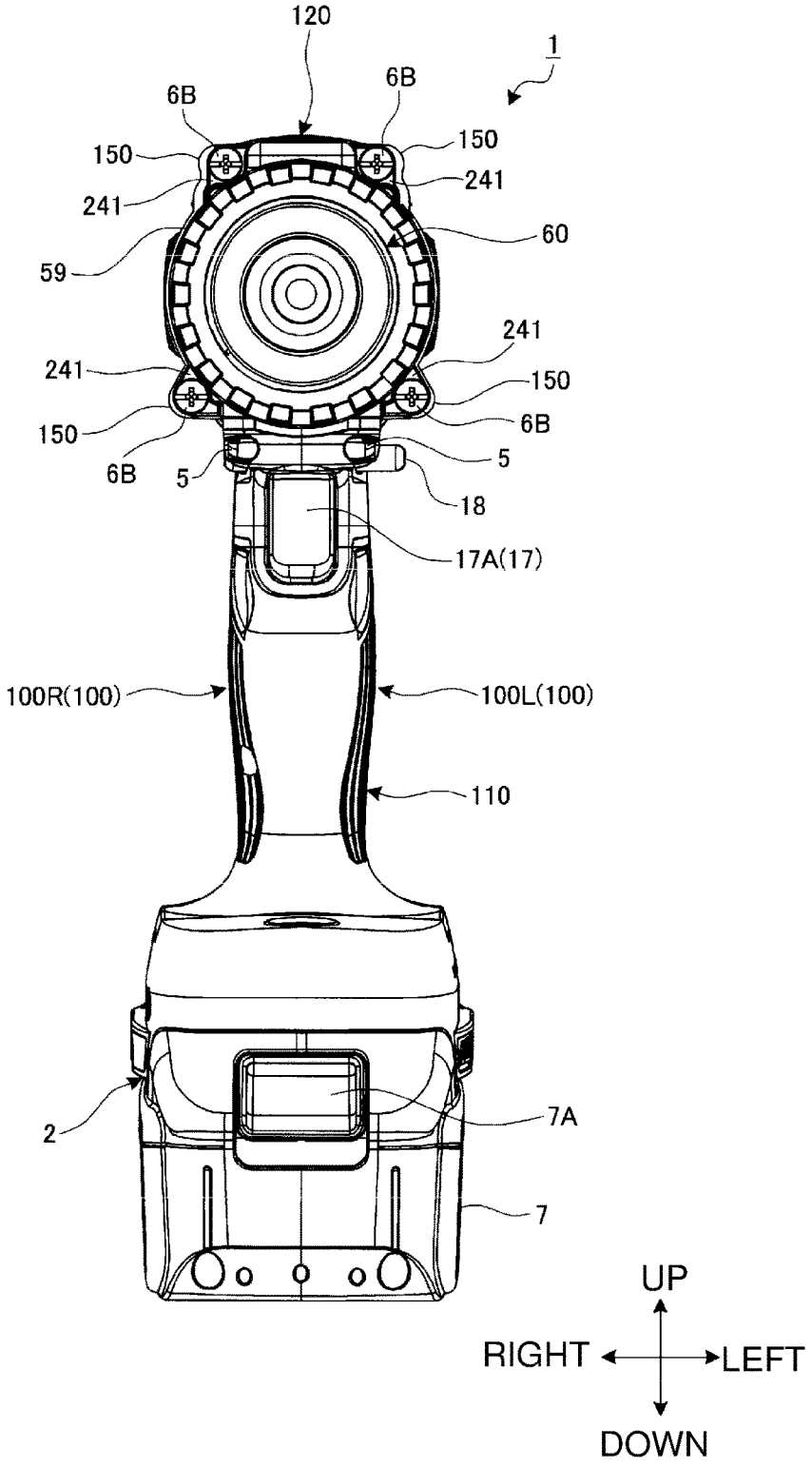
FIG. 2 is a front view of the power tool according to the first embodiment.
Figure 3:
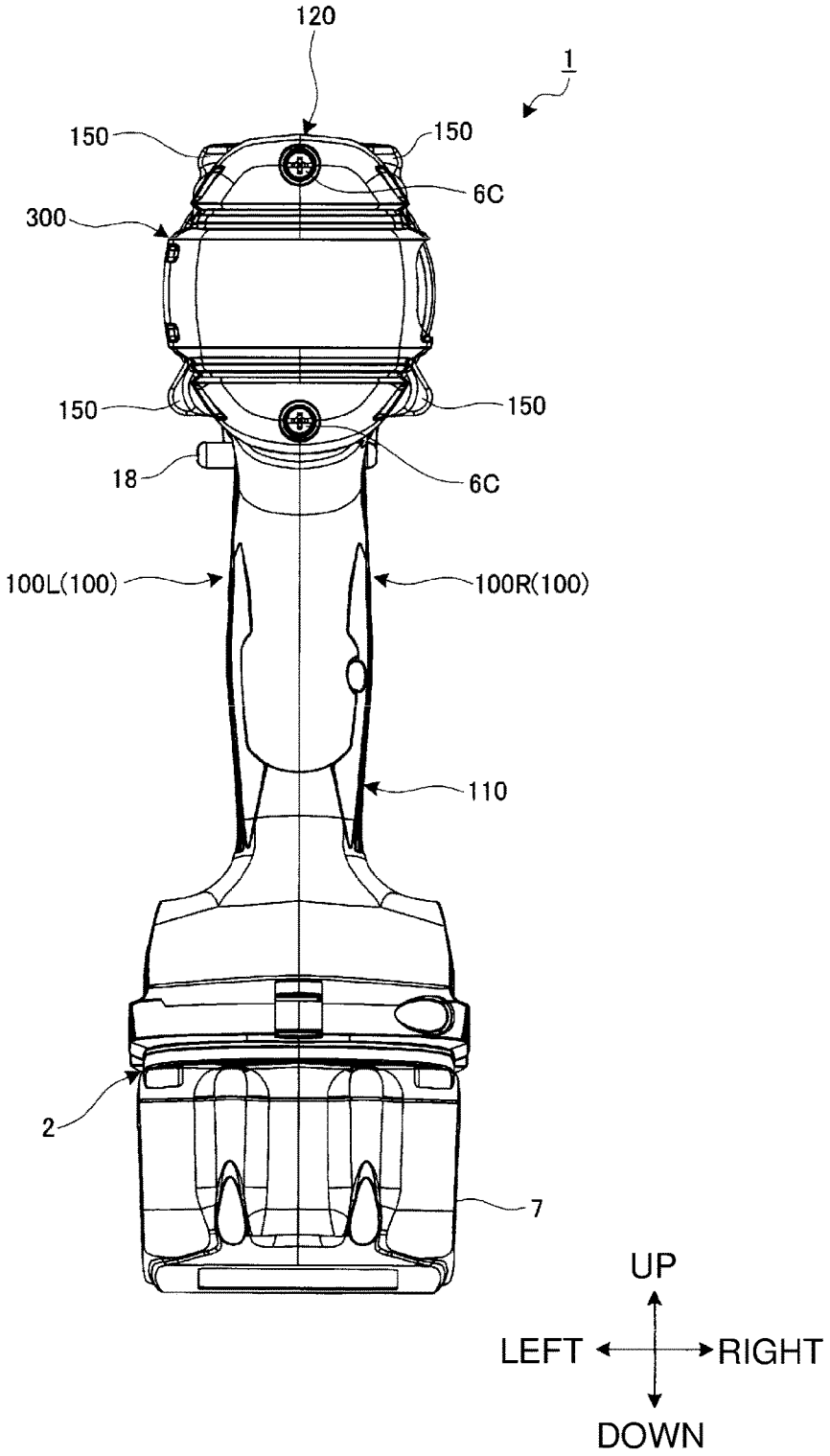
FIG. 3 is a rear view of the power tool according to the first embodiment.
Figure 4:
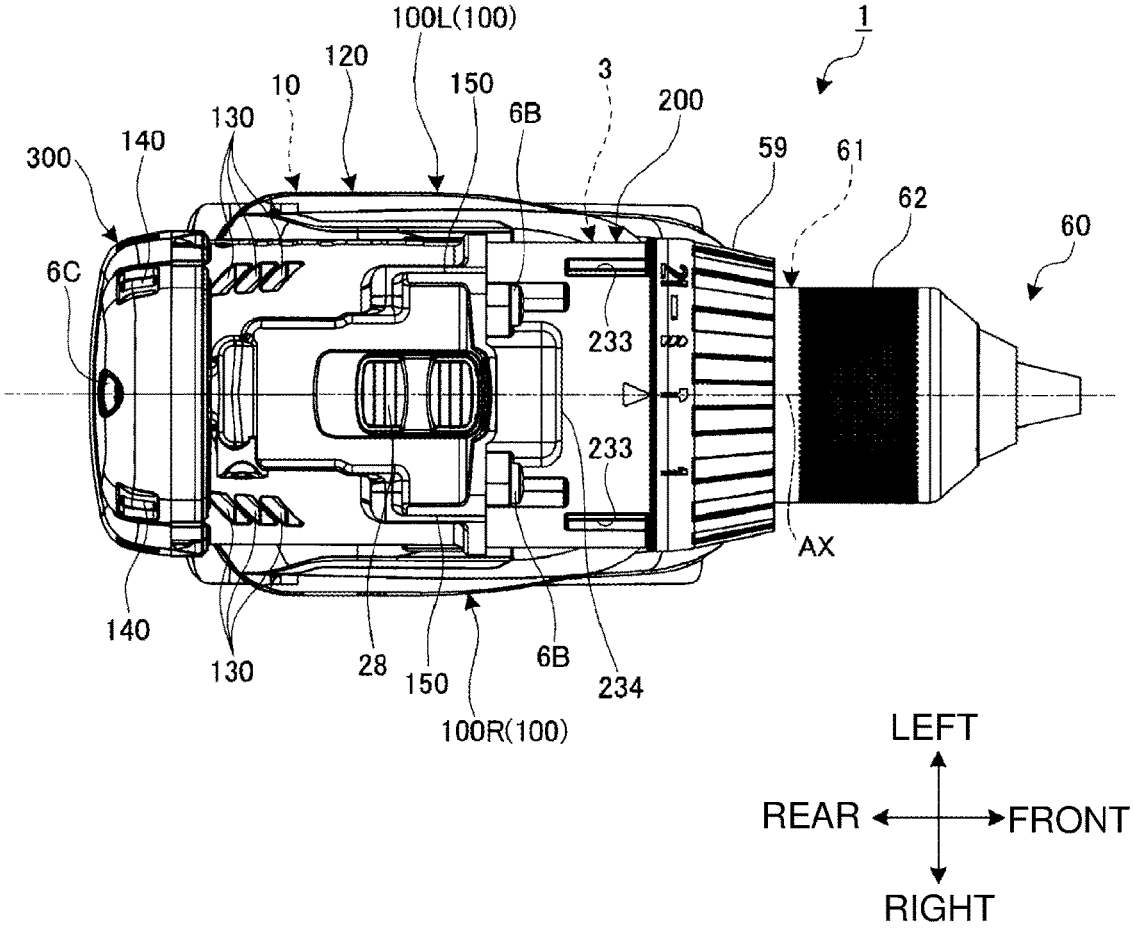
FIG. 4 is a top view of the power tool according to the first embodiment.

FIG. 1 is a side view of the power tool 1 according to the present embodiment. FIG. 2 is a front view of the power tool 1 according to the present embodiment. FIG. 3 is a rear view of the power tool 1 according to the present embodiment. FIG. 4 is a top view of the power tool 1 according to the present embodiment.

As shown in FIGS. 1 to 4, the power tool 1 includes a housing 100, a casing 200, a rear cover 300, a motor 10, a power transmission mechanism 3, an output mechanism 60, a battery mount 2, a controller 4, and illumination lights 5.

The power tool 1 also includes a trigger switch 17, a forward-reverse switch lever 18, a speed switch lever 28, and a change ring 59.

The housing 100 includes a grip housing 110 and a body housing 120. The body housing 120 is located above the grip housing 110. The body housing 120 is integral with the grip housing 110.

The housing 100 is formed from a synthetic resin. The housing 100 includes a left housing 100L and a right housing 100R. The left housing 100L and the right housing 100R are fastened together with screws 6A. The left housing 100L and the right housing 100R are fastened together to form the housing 100.

The grip housing 110 is gripped by an operator. The grip housing 110 protrudes downward from a lower portion of the body housing 120. The battery mount 2 is located below the grip housing 110.

The body housing 120 is cylindrical. The body housing 120 has a front opening partially receiving the casing 200. The body housing 120 has a rear hole covered by the rear cover 300. The casing 200 is fastened to the body housing 120 with screws 6B. The rear cover 300 is fastened to the body housing 120 with screws 6C.

The body housing 120 has inlets 130. The rear cover 300 has outlets 140. The outlets 140 are located behind the inlets 130. The inlets 130 connect the inside and the outside of the body housing 120. The outlets 140 connect the inside and the outside of the body housing 120. The inlets 130 are located in the right and left portions of the body housing 120. The outlets 140 are located in the right and left portions of the rear cover 300. Air outside the body housing 120 flows into the body housing 120 through the inlets 130. Air inside the body housing 120 flows out of the body housing 120 through the outlets 140.

The motor 10 generates power for driving the output mechanism 60. The motor 10 is accommodated in the body housing 120.

The power transmission mechanism 3 transmits power generated by the motor 10 to the output mechanism 60. The power transmission mechanism 3 includes multiple gears. The power transmission mechanism 3 is accommodated in the casing 200.

The output mechanism 60 is driven by power transmitted from the power transmission mechanism 3. The output mechanism 60 includes the spindle 61 and a chuck 62. The spindle 61 rotates about the rotation axis AX with power transmitted from the power transmission mechanism 3. The chuck 62 receives a tip tool.

The battery mount 2 is connected to a battery pack 7. The battery mount 2 is located below the grip housing 110. The battery pack 7 is attached to the battery mount 2. The battery pack 7 is detachable from the battery mount 2. The battery pack 7 is attached to the battery mount 2 to power the power tool 1.

The motor 10 is driven by power supplied from the battery pack 7.

The battery pack 7 may be a secondary battery. The battery pack 7 may be a rechargeable lithium-ion battery. The battery pack 7 includes a release button 7A. The release button 7A is operable to release the battery pack 7 fixed on the battery mount 2. The release button 7A is located on the front surface of the battery pack 7.

The controller 4 outputs a control signal for controlling the power tool 1. The controller 4 is accommodated in the grip housing 110.

The lamps 5 are located at the upper front of the grip housing 110. The illumination lights 5 emit illumination light that illuminates the front of the power tool 1. The illumination lights 5 include, for example, light-emitting diodes (LEDs). The two illumination lights 5 are located in the lateral direction.

The trigger switch 17 is located on the grip housing 110. The trigger switch 17 includes a trigger 17A and a switch circuit 17B. The switch circuit 17B is accommodated in the grip housing 110. The trigger 17A protrudes frontward from the upper front of the grip housing 110. The trigger 17A is operated by the operator. The trigger 17A is operated to switch the motor 10 between the driving state and the stopped state.

The forward-reverse switch lever 18 is located in an upper portion of the grip housing 110. The forward-reverse switch lever 18 is operated by the operator. The forward-reverse switch lever 18 is operated to switch the rotation direction of the motor 10 between forward and reverse. Switching the rotation direction of the motor 10 switches the rotation direction of the spindle 61.

The speed switch lever 28 is located in an upper portion of the body housing 120. The speed switch lever 28 is operated by the operator. The speed switch lever 28 is operated to switch the rotational speed of the spindle 61 between a first speed and a second speed higher than the first speed.

The change ring 59 is located in front of the casing 200. The change ring 59 is operated by the operator. The change ring 59 is operated to change the operation mode of the power tool 1.

The operation mode of the power tool 1 includes a vibration mode and a non-vibration mode. In the vibration mode, the spindle 61 vibrates in the axial direction. In the non-vibration mode, the spindle 61 does not vibrate in the axial direction. The non-vibration mode includes a drill mode and a clutch mode. In the drill mode, power transmission to the spindle 61 is enabled independently of a rotation load on the spindle 61. In the clutch mode, power transmission to the spindle 61 is disabled depending on a rotation load on the spindle 61.

The change ring 59 in the clutch mode is operated to set a release value for disabling power transmission to the spindle 61. The release value indicates a rotation load on the spindle 61. When the rotation load on the spindle 61 reaches the release value, the power transmission to the spindle 61 is disabled.

Casing

Figure 5:
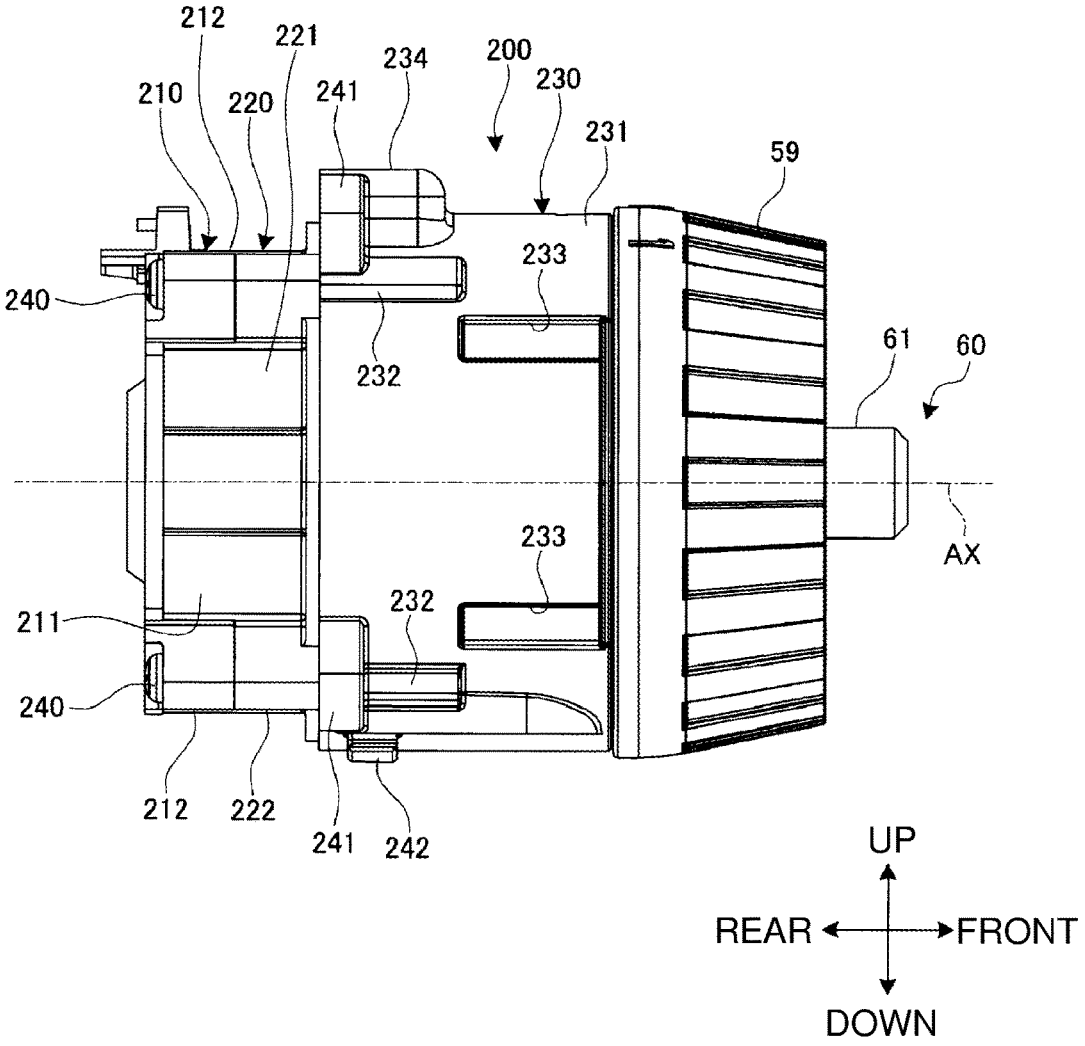
FIG. 5 is a side view of a casing according to the first embodiment.
Figure 6:
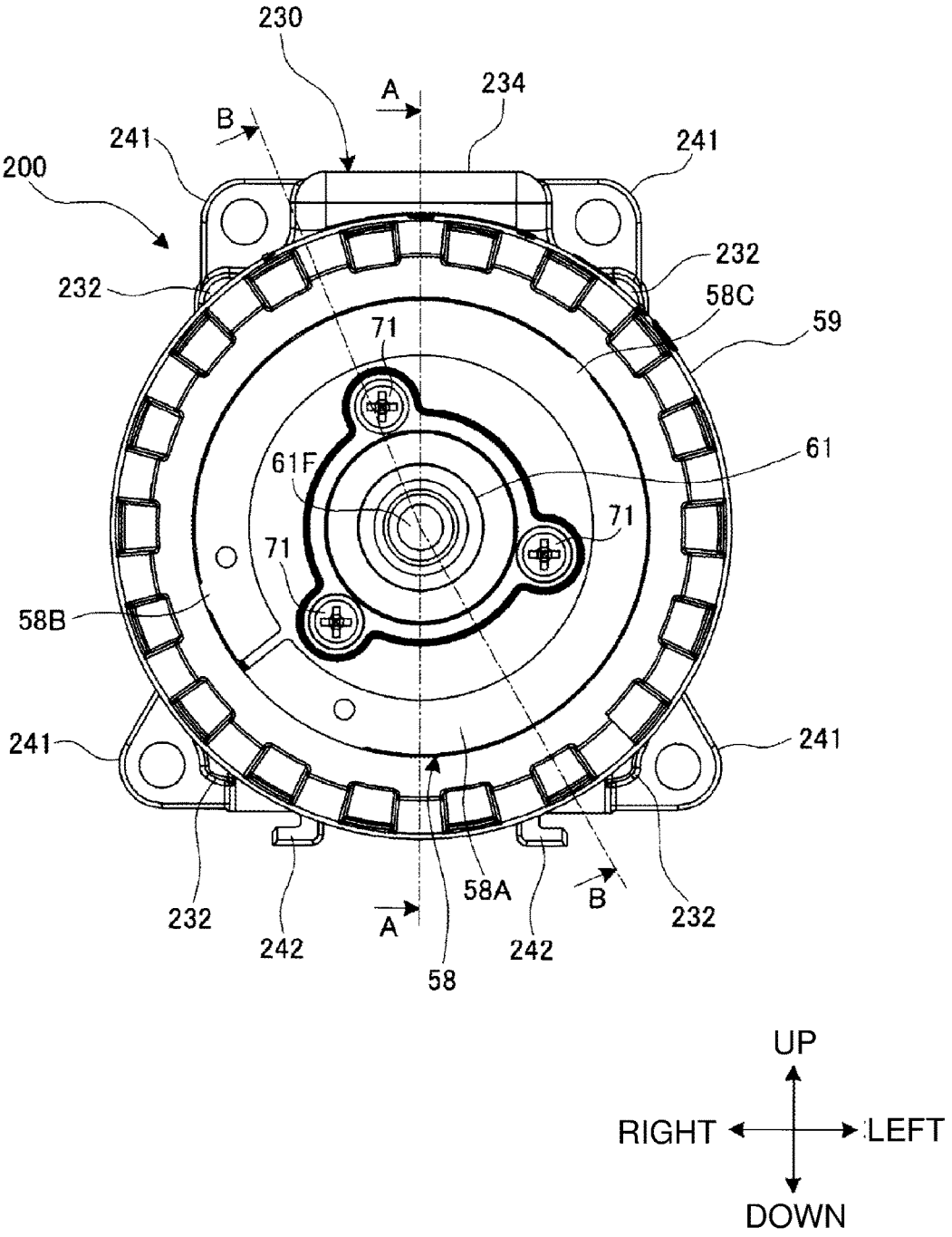
FIG. 6 is a front view of the casing according to the first embodiment.
Figure 7:
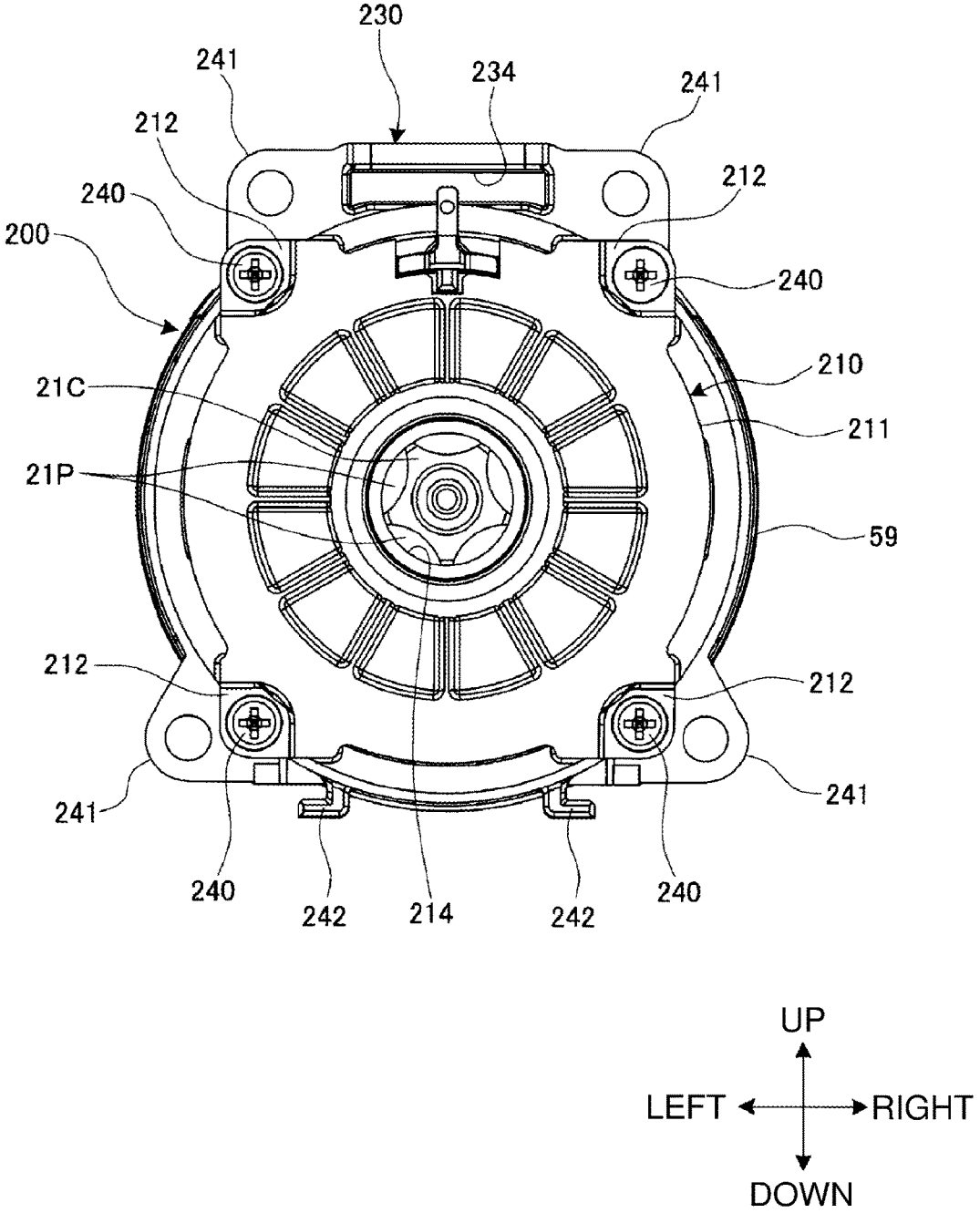
FIG. 7 is a rear view of the casing according to the first embodiment.

FIG. 5 is a side view of the casing 200 according to the present embodiment. FIG. 6 is a front view of the casing 200 according to the present embodiment. FIG. 7 is a rear view of the casing 200 according to the present embodiment.

As shown in FIGS. 5 to 7, the casing 200 includes a bracket 210, a gear case 220, and a gear housing 230. The gear case 220 is located in front of the bracket 210. The gear housing 230 is located in front of the gear case 220. The change ring 59 is located in front of the gear housing 230.

The bracket 210 includes an annular portion 211 and protrusions 212. The protrusions 212 protrude radially outward from the outer surface of the annular portion 211. The protrusions 212 are located circumferentially at intervals. Each protrusion 212 has a screw hole.

The gear case 220 includes an annular portion 221 and protrusions 222. The protrusions 222 protrude radially outward from the outer surface of the annular portion 221. The protrusions 222 are located circumferentially at intervals. Each protrusion 222 has a screw hole.

The gear housing 230 includes an outer cylinder 231 and protrusions 232. The protrusions 232 protrude radially outward from the outer surface of the outer cylinder 231. The protrusions 232 are located circumferentially at intervals. Each protrusion 232 has a screw hole.

The bracket 210, the gear case 220, and the gear housing 230 are fastened with screws 240 placed through the screw holes in the protrusions 222, 212, and 232.

The gear housing 230 includes recesses 233, a protruding portion 234, protrusions 241, and protrusions 242. The recesses 233 are located on the outer surface of the outer cylinder 231. The protruding portion 234 is located in an upper portion of the outer cylinder 231. The protrusions 241 protrude radially outward from the outer surface of the outer cylinder 231. The protrusions 242 are located in a lower portion of the outer cylinder 231.

The recesses 233 at least partially receive a side handle (not shown). The protrusions 241 protrude radially outward from the protrusions 232. Each protrusion 241 has a screw hole. The two protrusions 242 are located in the lateral direction in the lower portion of the outer cylinder 231. The left protrusion 242 has a lower part bent leftward. The right protrusion 242 has a lower part bent rightward.

As shown in FIGS. 1 to 4, the casing 200 is at least partially placed in the body housing 120 through the front opening in the body housing 120. The casing 200 is at least partially located in front of the body housing 120. The bracket 210, the gear case 220, and the rear of the gear housing 230 are located inside the body housing 120. The protrusions 242 are in contact with the inner surface of the body housing 120. With the protrusions 242 in contact with the inner surface of the body housing 120, the body housing 120 and the casing 200 are less likely to separate from each other.

The body housing 120 has protrusions 150 protruding radially outward from the outer surface of the body housing 120. The protrusions 150 are located circumferentially at intervals. Each protrusion 150 has a screw hole. The body housing 120 and the casing 200 are fastened with screws 6C placed through the screw holes in the protrusions 150 and 241.

The gear housing 230 has the protruding portion 234 in front of the speed switch lever 28. The speed switch lever 28 has a front portion facing the protruding portion 234. The protruding portion 234 has a hole in its rear surface for receiving the front portion of the speed switch lever 28.

The spindle 61 has its front end located in front of the change ring 59.

Overview of Internal Structure of Power Tool

Figure 8:
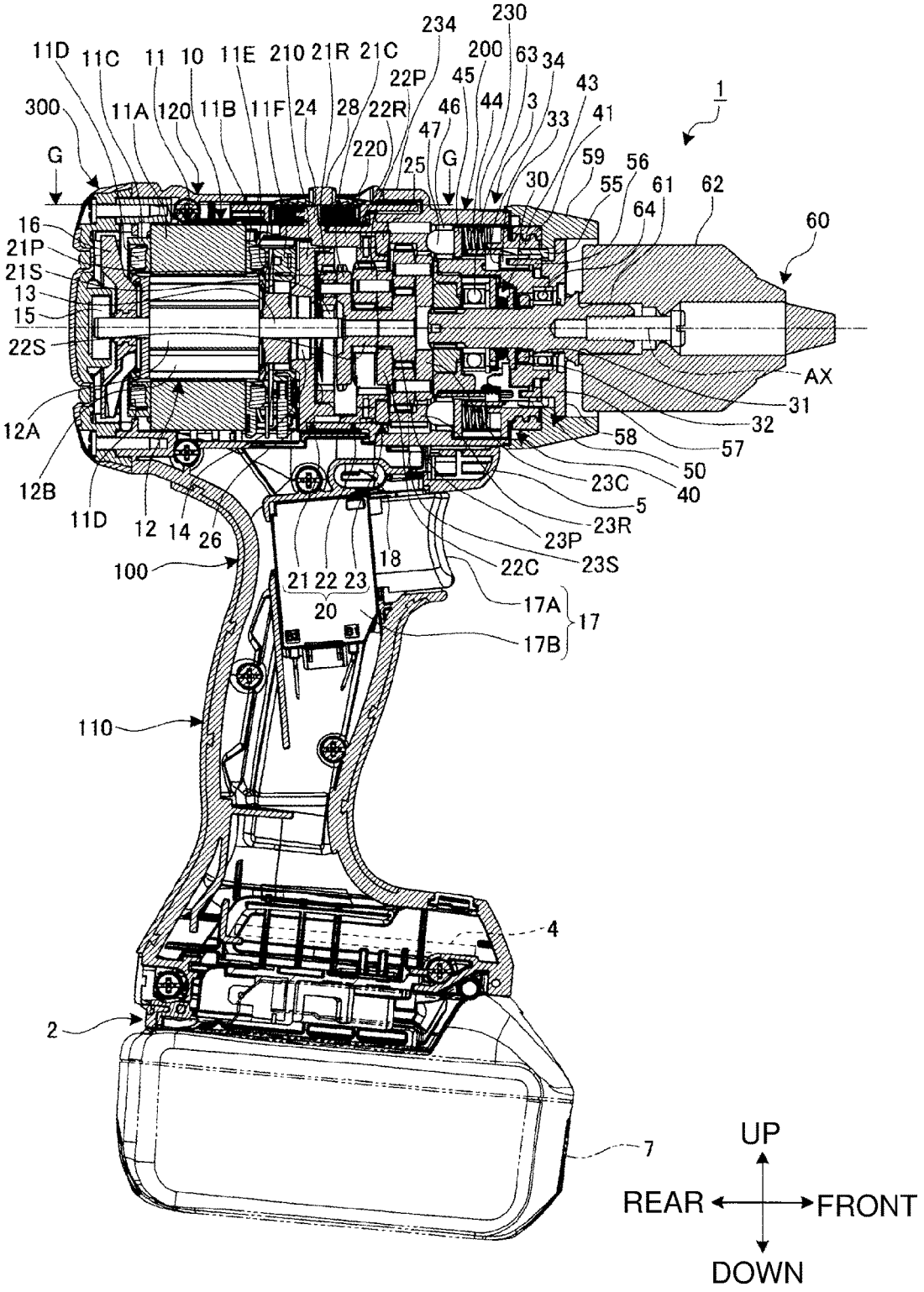
FIG. 8 is a cross-sectional view of the power tool according to the first embodiment.

FIG. 8 is a side cross-sectional view of the power tool 1 according to the present embodiment.

The switch circuit 17B is located in the upper portion of the grip housing 110. The switch circuit 17B is connected to the trigger 17A. In response to the trigger 17A being operated, the switch circuit 17B outputs an operation signal for driving the motor 10 to the controller 4. In response to the trigger 17A being operated, the battery pack 7 powers the motor 10 to drive the motor 10. The motor 10 is driven in response to the operation signal output from the switch circuit 17B.

The controller 4 is located in a lower portion of the grip housing 110. The controller 4 includes a control circuit board for driving the motor 10. The controller 4 outputs a control signal for driving the motor 10 in response to the operation signal output from the switch circuit 17B.

The motor 10 is accommodated in the body housing 120. The motor 10 has a rotation axis extending in the front-rear direction. The rotation axis of the motor 10 corresponds to the rotation axis AX of the spindle 61. The operator operates the trigger switch 17 to activate the motor 10. The operator operates the forward-reverse switch lever 18 to switch the rotation direction of the motor 10.

The motor 10 is an inner-rotor brushless motor. The motor 10 includes a cylindrical stator 11, a rotor 12, and a rotational shaft 13. The rotor 12 is located inside the stator 11. The rotational shaft 13 is located inside the rotor 12.

The stator 11 includes a stator core 11A, a front insulator 11B, a rear insulator 11C, multiple coils 11D, a sensor circuit board 11E, and a connector 11F. The stator core 11A includes multiple steel plates stacked on one another. The front insulator 11B is located in front of the stator core 11A. The rear insulator 11C is located behind the stator core 11A. The coils 11D are wound around the stator core 11A with the front insulator 11B and the rear insulator 11C in between. The sensor circuit board 11E is attached to the front insulator 11B. The connector 11F is supported by the front insulator 11B. The sensor circuit board 11E includes multiple rotation detecting elements to detect rotation of the rotor 12. The connector 11F connects the coils 11D with one another. The connector 11F is connected to the controller 4 with lead wires.

The rotor 12 includes a cylindrical rotor core 12A and multiple permanent magnets 12B. The rotor core 12A surrounds the rotational shaft 13. The permanent magnets 12B are held by the rotor core 12A.

The rotational shaft 13 rotates as the rotor 12 rotates. The rotation axis of the rotational shaft 13 corresponds to the rotation axis AX of the spindle 61. The rotational shaft 13 has a front portion rotatably supported by a bearing 14. The rotational shaft 13 has a rear portion rotatably supported by a bearing 15.

A centrifugal fan 16 is mounted on the rotational shaft 13. The centrifugal fan 16 is mounted on a part of the rotational shaft 13 between the bearing 15 and the stator 11. The outlets 140 are located in parts of the periphery of the centrifugal fan 16. As the rotational shaft 13 rotates and the centrifugal fan 16 rotates, air inside the body housing 120 is discharged out of the body housing 120 through the outlets 140.

The rotational shaft 13 receives a pinion gear 21S on its front end. The rotational shaft 13 is connected to the power transmission mechanism 3 via the pinion gear 21S.

The power transmission mechanism 3 includes a reduction mechanism 20, a vibration mechanism 30, a clutch mechanism 40, and a mode switch mechanism 50.

The reduction mechanism 20 reduces the rotation of the rotational shaft 13 and rotates the spindle 61 at a lower rotational speed than the rotational shaft 13. The operator operates the reduction mechanism 20 by operating the speed switch lever 28.

The vibration mechanism 30 vibrates the spindle 61 in the axial direction.

When the rotation load on the spindle 61 reaches the release value, the clutch mechanism 40 disables power transmission to the spindle 61.

The mode switch mechanism 50 changes the operation mode of the power tool 1. The operator operates the mode switch mechanism 50 by operating the change ring 59. The vibration mechanism 30 and the clutch mechanism 40 operate in response to the operation of the mode switch mechanism 50.

The output mechanism 60 holding the tip tool is driven by power output from the motor 10 and transmitted from the power transmission mechanism 3.

Components of Power Transmission Mechanism and Output Mechanism

Figure 9:
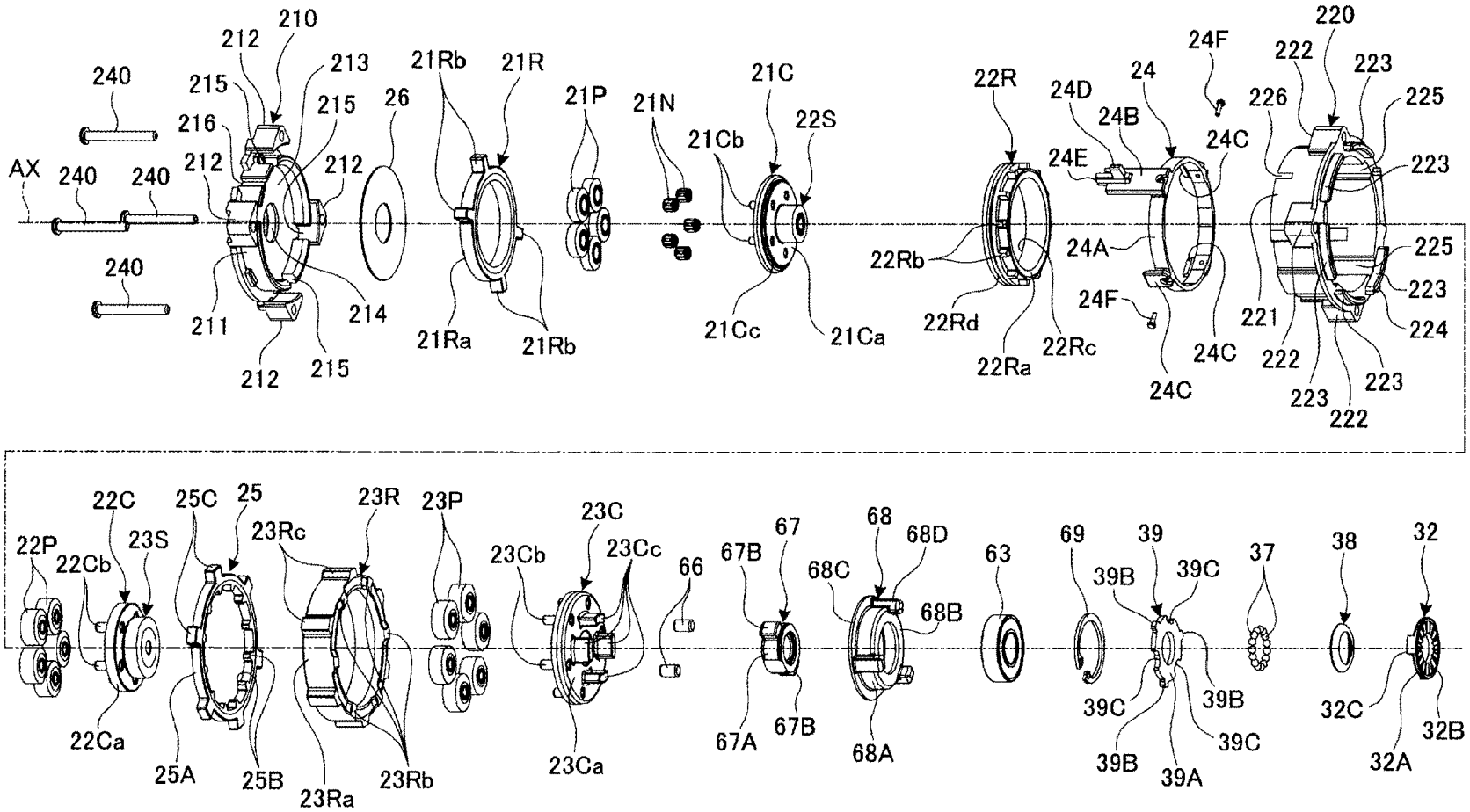
FIG. 9 is an exploded perspective view of a rear portion of a power transmission mechanism according to the first embodiment.
Figure 10:
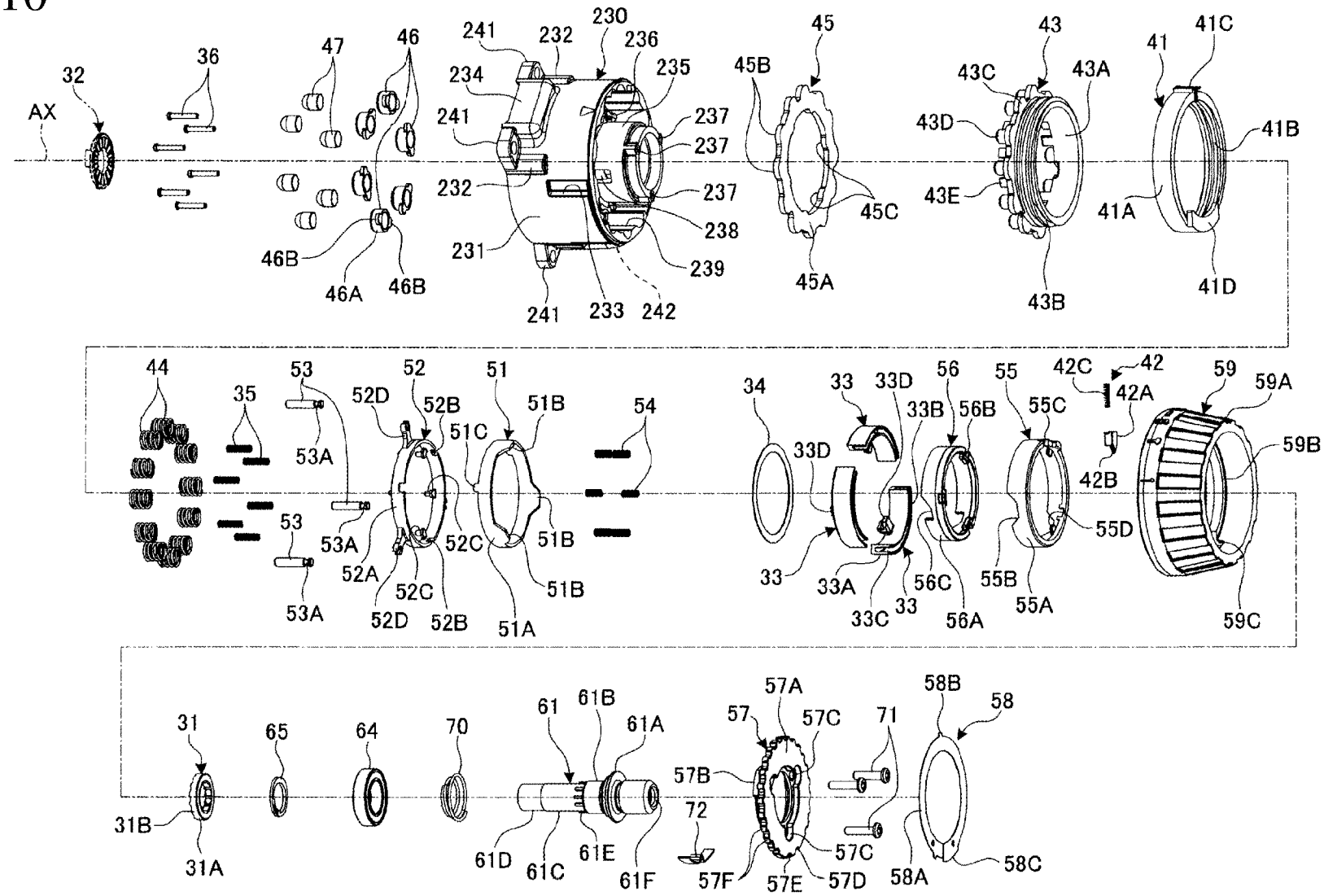
FIG. 10 is an exploded perspective view of a front portion of the power transmission mechanism and an output mechanism according to the first embodiment.

FIG. 9 is an exploded perspective view of a rear portion of the power transmission mechanism 3 according to the present embodiment. FIG. 10 is an exploded perspective view of a front portion of the power transmission mechanism 3 and the output mechanism 60 according to the present embodiment.

As shown in FIGS. 8 to 10, the casing 200 includes the bracket 210, the gear case 220, and the gear housing 230.

The bracket 210 includes the annular portion 211, the protrusions 212, a disk 213, a hole 214, slits 215, and a groove 216.

The annular portion 211 surrounds the rotation axis AX. The protrusions 212 protrude radially outward from the outer surface of the annular portion 211. The disk 213 is connected to the annular portion 211 to cover a rear opening in the annular portion 211. The hole 214 is located in the center of the disk 213. The slits 215 are located in the annular portion 211. The slits 215 extend in the axial direction. The slits 215 are located circumferentially at intervals. The groove 216 is located in an upper portion of the annular portion 211. The groove 216 extends in the front-rear direction.

The gear case 220 includes the annular portion 221, the protrusions 222, ribs 223, a protruding portion 224, guide grooves 225, and a slit 226.

The annular portion 221 surrounds the rotation axis AX. The protrusions 222 protrude radially outward from the outer surface of the annular portion 221. The ribs 223 are located on the front surface of the annular portion 221. The ribs 223 are arc-shaped in a plane orthogonal to the rotation axis AX. The ribs 223 are located circumferentially at intervals. The protruding portion 224 protrudes radially outward from the outer surface of one of the ribs 223. The guide grooves 225 are located on the inner surface of the annular portion 221. The guide grooves 225 extend in the axial direction. The guide grooves 225 are located circumferentially at intervals. The slit 226 extends frontward from the rear surface of the annular portion 221.

The gear housing 230 includes the outer cylinder 231, the protrusions 232, the recesses 233, the protruding portion 234, an inner cylinder 235, a ring 236, screw holes 237, through-holes 238, recesses 239, the protrusions 241, and the protrusions 242.

The outer cylinder 231 surrounds the rotation axis AX. The protrusions 232 protrude radially outward from the outer surface of the outer cylinder 231. The recesses 233 are located on the outer surface of the outer cylinder 231. The recesses 233 are located circumferentially at intervals. The protruding portion 234 is located in an upper portion of the outer cylinder 231.

The inner cylinder 235 is located inside the outer cylinder 231. The inner cylinder 235 surrounds the rotation axis AX. The ring 236 connects the outer cylinder 231 and the inner cylinder 235. The screw holes 237 are located in the front surface of the inner cylinder 235. The through-holes 238 extend through the inner cylinder 235 from the inner to outer surfaces. The through-holes 238 are located circumferentially. The recesses 239 are located on the inner surface of the outer cylinder 231. The recesses 239 extend in the front-rear direction. The recesses 239 are located circumferentially. The protrusions 241 protrude radially outward from the outer surface of the outer cylinder 231. The protrusions 241 are located circumferentially at intervals.

The bracket 210, the gear case 220, and the gear housing 230 are fastened with the screws 240.

As shown in FIGS. 8 to 10, the reduction mechanism 20 includes a first planetary gear mechanism 21, a second planetary gear mechanism 22, a third planetary gear mechanism 23, a speed switch ring 24, a connection ring 25, and a washer 26.

The first planetary gear mechanism 21 includes an internal gear 21R, a first carrier 21C, multiple planetary gears 21P, and needle bearings 21N.

The internal gear 21R includes a ring 21Ra and protrusions 21Rb. The ring 21Ra includes internal teeth on its inner surface. The ring 21Ra surrounds the rotation axis AX. The protrusions 21Rb protrude radially outward from the outer surface of the ring 21Ra. The protrusions 21Rb are located circumferentially at intervals.

The first carrier 21C includes a disk 21Ca, pins 21Cb, and external teeth 21Cc. The pins 21Cb protrude rearward from the rear surface of the disk 21Ca. The pins 21Cb are located circumferentially. The pins 21Cb rotatably support the planetary gears 21P with the needle bearings 21N in between. The external teeth 21Cc are located on the outer edge of the front surface of the disk 21Ca.

The second planetary gear mechanism 22 includes an internal gear 22R, a second carrier 22C, multiple planetary gears 22P, and a sun gear 22S.

The internal gear 22R includes a ring 22Ra, external teeth 22Rb, internal teeth 22Rc, and a groove 22Rd. The ring 22Ra surrounds the rotation axis AX. The external teeth 22Rb protrude radially outward from the outer surface of the ring 22Ra. The external teeth 22Rb are located circumferentially at intervals. The internal teeth 22Rc are located on the rear surface of the ring 22Ra. The groove 22Rd is located on the outer rear surface of the ring 22Ra. The groove 22Rd extends circumferentially.

The second carrier 22C includes a disk 22Ca and pins 22Cb. The pins 22Cb protrude rearward from the rear surface of the disk 22Ca. The pins 22Cb are located circumferentially. The pins 22Cb rotatably support the planetary gears 22P.

The sun gear 22S is located in front of the first carrier 21C. The sun gear 22S has a smaller diameter than the first carrier 21C. The sun gear 22S is integral with the first carrier 21C. The sun gear 22S and the first carrier 21C rotate together.

The third planetary gear mechanism 23 includes an internal gear 23R, a third carrier 23C, multiple planetary gears 23P, and a sun gear 23S.

The internal gear 23R includes a ring 23Ra, clutch cams 23Rb, and protrusions 23Rc. The ring 23Ra surrounds the rotation axis AX. The clutch cams 23Rb protrude frontward from the front surface of the ring 23Ra. The clutch cams 23Rb are located circumferentially at intervals. The protrusions 23Rc protrude radially outward from the outer surface of the ring 23Ra. The protrusions 23Rc are located circumferentially at intervals. The clutch cams 23Rb and the protrusions 23Rc are located at circumferentially different positions.

The third carrier 23C includes a disk 23Ca, pins 23Cb, and protrusions 23Cc. The pins 23Cb protrude rearward from the rear surface of the disk 23Ca. The pins 23Cb are located circumferentially. The pins 23Cb rotatably support the planetary gears 23P. The protrusions 23Cc protrude frontward from the front surface of the disk 23Ca. The protrusions 23Cc are located circumferentially at intervals. The protrusions 23Cc are arc-shaped in a plane orthogonal to the rotation axis AX.

The sun gear 23S is located in front of the second carrier 22C. The sun gear 23S has a smaller diameter than the second carrier 22C. The sun gear 23S is integral with the second carrier 22C. The sun gear 23S and the second carrier 22C rotate together.

The speed switch ring 24 includes a ring 24A, a joint 24B, protrusions 24C, a projection 24D, a projection 24E, and pins 24F.

The ring 24A surrounds the rotation axis AX. The joint 24B extends rearward from the ring 24A. The protrusions 24C at least partially protrude radially outward from the outer surface of the ring 24A. The protrusions 24C at least partially protrude rearward from the rear surface of the ring 24A. The projection 24D protrudes radially outward from the rear of the joint 24B. The projection 24E protrudes rearward from the rear of the joint 24B. Each pin 24F is received in a hole in a part of the ring 24A.

The connection ring 25 includes a ring 25A, internal teeth 25B, and protrusions 25C.

The ring 25A surrounds the rotation axis AX. The internal teeth 25B are located on the inner surface of the ring 25A. The internal teeth 25B are located circumferentially at intervals. The protrusions 25C protrude radially outward from the outer surface of the ring 25A. The protrusions 25C are located circumferentially at intervals.

The washer 26 surrounds the rotation axis AX. The washer 26 is located between the disk 213 of the bracket 210 and the planetary gears 21P in the axial direction.

As shown in FIGS. 8 to 10, the vibration mechanism 30 includes a first cam 31, a second cam 32, a vibration switch lever 33, a washer 34, coil springs 35, and pins 36.

The first cam 31 includes a ring 31A and cam teeth 31B. The ring 31A surrounds the rotation axis AX. The cam teeth 31B are located on the rear surface of the ring 31A.

The second cam 32 includes a ring 32A, cam teeth 32B, and tabs 32C. The ring 32A surrounds the rotation axis AX. The cam teeth 32B are located on the front surface of the ring 32A. The tabs 32C are located on the rear surface of the ring 32A. The tabs 32C protrude rearward from the rear surface of the second cam 32. The tabs 32C are located circumferentially.

The vibration switch lever 33 includes bodies 33A, grooves 33B, protruding portions 33C, and tabs 33D. The three bodies 33A surround the rotation axis AX. The bodies 33A are arc-shaped in a plane orthogonal to the rotation axis AX. Each groove 33B extends rearward from the front surface of the corresponding body 33A. The openings in the grooves 33B are arc-shaped in a plane orthogonal to the rotation axis AX. The protruding portions 33C are located inside the grooves 33B. The protruding portions 33C protrude frontward. Each tab 33D protrudes radially inward from the inner surface of the corresponding body 33A.

The washer 34 surrounds the rotation axis AX.

The coil springs 35 are located behind the vibration switch lever 33 and the washer 34. The coil springs 35 generate an elastic force for moving the vibration switch lever 33 forward.

The pins 36 support the coil springs 35.

The vibration mechanism 30 includes balls 37, a first holder 38, and a second holder 39.

The balls 37 surround the rotation axis AX.

The first holder 38 surrounds the rotation axis AX. The first holder 38 has a curved rear surface. The first holder 38 supports the balls 37 on its curved rear surface.

The second holder 39 includes a ring 39A, protrusions 39B, and recesses 39C. The ring 39A surrounds the rotation axis AX. The protrusions 39B protrude radially outward from the outer surface of the ring 39A. The protrusions 39B are located circumferentially at intervals. Each recess 39C is located between the circumferentially adjacent protrusions 39B.

As shown in FIGS. 8 to 10, the clutch mechanism 40 includes a clutch switch ring 41, a lock lever 42, a spring holder 43, coil springs 44, a washer 45, clutch pin sleeves 46, and clutch pins 47.

The clutch switch ring 41 includes a ring 41A, a threaded groove 41B, a lock lever holder 41C, and an arc plate 41D.

The ring 41A surrounds the rotation axis AX. The threaded groove 41B is located on the inner surface of the ring 41A. The lock lever holder 41C is located in an upper portion of the ring 41A. The lock lever holder 41C includes a first projection and a second projection. The arc plate 41D is located on the lower front surface of the ring 41A. The arc plate 41D is arc-shaped in a plane orthogonal to the rotation axis AX.

The lock lever 42 includes a base 42A, a follower 42B, and a spring 42C. The base 42A is cylindrical. The follower 42B is located radially inside the base 42A. The spring 42C surrounds the base 42A.

The spring holder 43 includes an annular portion 43A, a thread 43B, a support plate 43C, spring holding members 43D, and ribs 43E. The annular portion 43A surrounds the rotation axis AX. The thread 43B is located on the outer surface of the annular portion 43A. The support plate 43C is located at the rear of the annular portion 43A. The support plate 43C has an outer edge located radially outward from the outer surface of the annular portion 43A. The spring holding members 43D are located on the rear surface of the support plate 43C. The spring holding members 43D are solid cylinders. The spring holding members 43D protrude rearward from the rear surface of the support plate 43C. The spring holding members 43D are located circumferentially at intervals. The ribs 43E protrude rearward from the rear surface of the annular portion 43A.

The spring holding members 43D hold the coil springs 44.

The washer 45 includes a ring 45A, protruding portions 45B, and protruding portions 45C. The ring 45A surrounds the rotation axis AX. The protruding portions 45B protrude radially outward from the outer surface of the ring 45A. The protruding portions 45B are located circumferentially at intervals. The protruding portions 45C protrude radially inward from the inner surface of the ring 45A. The protruding portions 45C are located circumferentially at intervals.

The clutch pin sleeves 46 each include an annular portion 46A and protruding portions 46B. The annular portions 46A surround the rotation axis AX. Each annular portion 46A includes the protruding portions 46B. Each annular portion 46A includes the protruding portions 46B on the front end. The protruding portions 46B protrude radially outward from the front end of each annular portion 46A.

The clutch pins 47 are supported by the clutch pin sleeves 46. Each clutch pin 47 has a front portion received in the annular portion 46A of the corresponding clutch pin sleeve 46. Each clutch pin 47 has a rear portion protruding rearward from the corresponding annular portion 46A with its front portion received in the corresponding annular portion 46A. The rear portion of each clutch pin 47 is spherical.

The washer 45 is located behind the coil springs 44. The clutch pins 47 are located behind the washer 45. The coil springs 44 generate an elastic force for moving the washer 45 and the clutch pins 47 rearward.

As shown in FIGS. 8 to 10, the mode switch mechanism 50 includes a support ring 51, a pin holder 52, lock pins 53, coil springs 54, a drill switch ring 55, a vibration switch ring 56, a cam plate 57, and a cover ring 58.

The support ring 51 includes a ring 51A, cam projections 51B, and protrusions 51C. The ring 51A surrounds the rotation axis AX. The cam projections 51B protrude frontward from the front end of the ring 51A. The cam projections 51B are located circumferentially at intervals. The protrusions 51C protrude rearward from the rear end of the ring 51A. The protrusions 51C are located circumferentially at intervals.

The pin holder 52 includes a ring 52A, recesses 52B, spring holding members 52C, and pin holding members 52D. The ring 52A surrounds the rotation axis AX. The recesses 52B are located on the front end of the ring 52A. The recesses 52B are located circumferentially at intervals. The spring holding members 52C hold the coil springs 54. The spring holding members 52C protrude partially radially inward from the inner surface of the ring 52A. The spring holding members 52C partially protrude rearward. The spring holding members 52C are located circumferentially at intervals. The pin holding members 52D hold the lock pins 53. The pin holding members 52D protrude radially outward from the outer surface of the ring 52A. The pin holding members 52D are located circumferentially at intervals.

The lock pins 53 are solid cylinders extending in the front-rear direction. Each lock pin 53 has a ring groove 53A on its front end. The lock pins 53 are held by the pin holding members 52D. Each pin holding member 52D surrounds the corresponding groove 53A.

The coil springs 54 generate an elastic force for moving the pin holder 52 forward. The coil springs 54 are held by the spring holding members 52C.

The drill switch ring 55 includes a ring 55A, cam recesses 55B, a recess 55C, and protrusions 55D. The ring 55A surrounds the rotation axis AX. The cam recesses 55B are located on the rear of the ring 55A. The cam recesses 55B are located circumferentially at intervals. The recess 55C is located on the front of the ring 55A. The protrusions 55D protrude radially inward from the inner surface of the ring 55A.

The vibration switch ring 56 includes a ring 56A, recesses 56B, and recesses 56C. The ring 56A surrounds the rotation axis AX. The recesses 56B are located on the front outer surface of the ring 56A. The recesses 56B are located circumferentially at intervals. The recesses 56C are located on the rear surface of the ring 56A. The recesses 56C are located circumferentially at intervals.

The cam plate 57 includes a front cam plate 57A, a rear cam plate 57B, and screw holes 57C. The rear cam plate 57B is located behind the front cam plate 57A. The rear cam plate 57B is integral with the front cam plate 57A. The rear cam plate 57B has a smaller profile than the front cam plate 57A. The screw holes 57C receive screws 71.

The front cam plate 57A has a notch 57D, a notch 57E, and multiple notches 57F. The notches 57D, 57E, and 57F are located on the circumference of the front cam plate 57A. A leaf spring 72 is received in a part of the circumference of the front cam plate 57A. The leaf spring 72 has a middle portion bent radially inward. The middle portion of the leaf spring 72 is received in one of the notches 57D, 57E, and 57F.

The cover ring 58 includes a ring 58A, a protruding portion 58B, and a hook 58C. The ring 58A surrounds the rotation axis AX. The protruding portion 58B protrudes radially outward from the outer edge of the ring 58A. The hook 58C protrudes radially outward from the outer edge of the ring 58A.

The change ring 59 includes an operation ring 59A, a rib 59B, and a recess 59C. The operation ring 59A surrounds the rotation axis AX. The rib 59B is located on the inner surface of the operation ring 59A. The rib 59B protrudes radially inward from the inner surface of the operation ring 59A. The recess 59C is located on a part of the inner surface of the operation ring 59A.

As shown in FIGS. 8 to 10, the output mechanism 60 includes the spindle 61, the chuck 62, a bearing 63, and a bearing 64. FIGS. 9 and 10 do not show the chuck 62.

The spindle 61 includes a flange 61A, a front step 61B, a middle step 61C, a rear step 61D, an attachment portion 61E, and a spindle hole 61F. The front step 61B is located behind the flange 61A.

The chuck 62 holds the tip tool. The chuck 62 is connected to the front of the spindle 61. The chuck 62 rotates as the spindle 61 rotates. The chuck 62 rotates while holding the tip tool.

The bearing 63 and the bearing 64 rotatably support the spindle 61. The spindle 61, supported by the bearings 63 and 64, is movable in the front-rear direction.

The output mechanism 60 includes a circlip 65, rollers 66, a lock cam 67, a lock ring 68, a clip 69, and a coil spring 70.

The lock cam 67 includes an annular portion 67A and a pair of protrusions 67B. The protrusions 67B protrude radially outward from the outer surface of the annular portion 67A. The rear step 61D of the spindle 61 is connected in a hole in the annular portion 67A of the lock cam 67 with splines.

The lock ring 68 includes an annular portion 68A, an inner flange 68B, an outer flange 68C, and protruding portions 68D. The annular portion 68A covers the lock cam 67. The inner flange 68B protrudes radially inward from the inner front end of the annular portion 68A. The outer flange 68C protrudes radially outward from the outer rear end of the annular portion 68A. The protruding portions 68D protrude radially outward from the outer surface of the annular portion 68A. The protruding portions 68D are located circumferentially at intervals. Each protruding portion 68D has a front portion protruding frontward from the front surface of the annular portion 68A.

The clip 69 presses the bearing 63.

The coil spring 70 is located between the bearing 64 and the flange 61A. The coil spring 70 generates an elastic force for moving the spindle 61 forward.

Internal Structures of Power Transmission Mechanism and Output Mechanism

Figure 11:
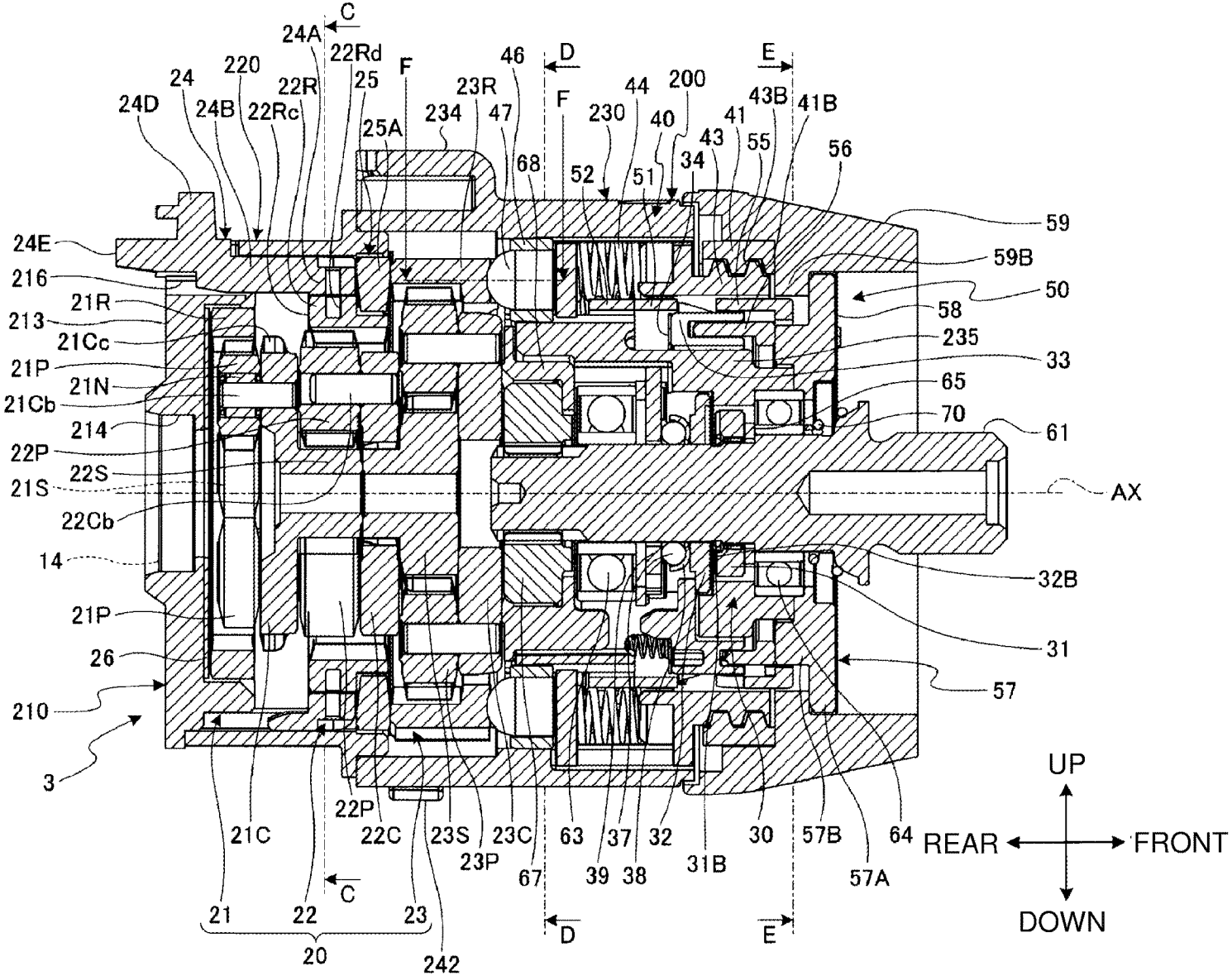
FIG. 11 is a side cross-sectional view of the power transmission mechanism according to the first embodiment.
Figure 12:
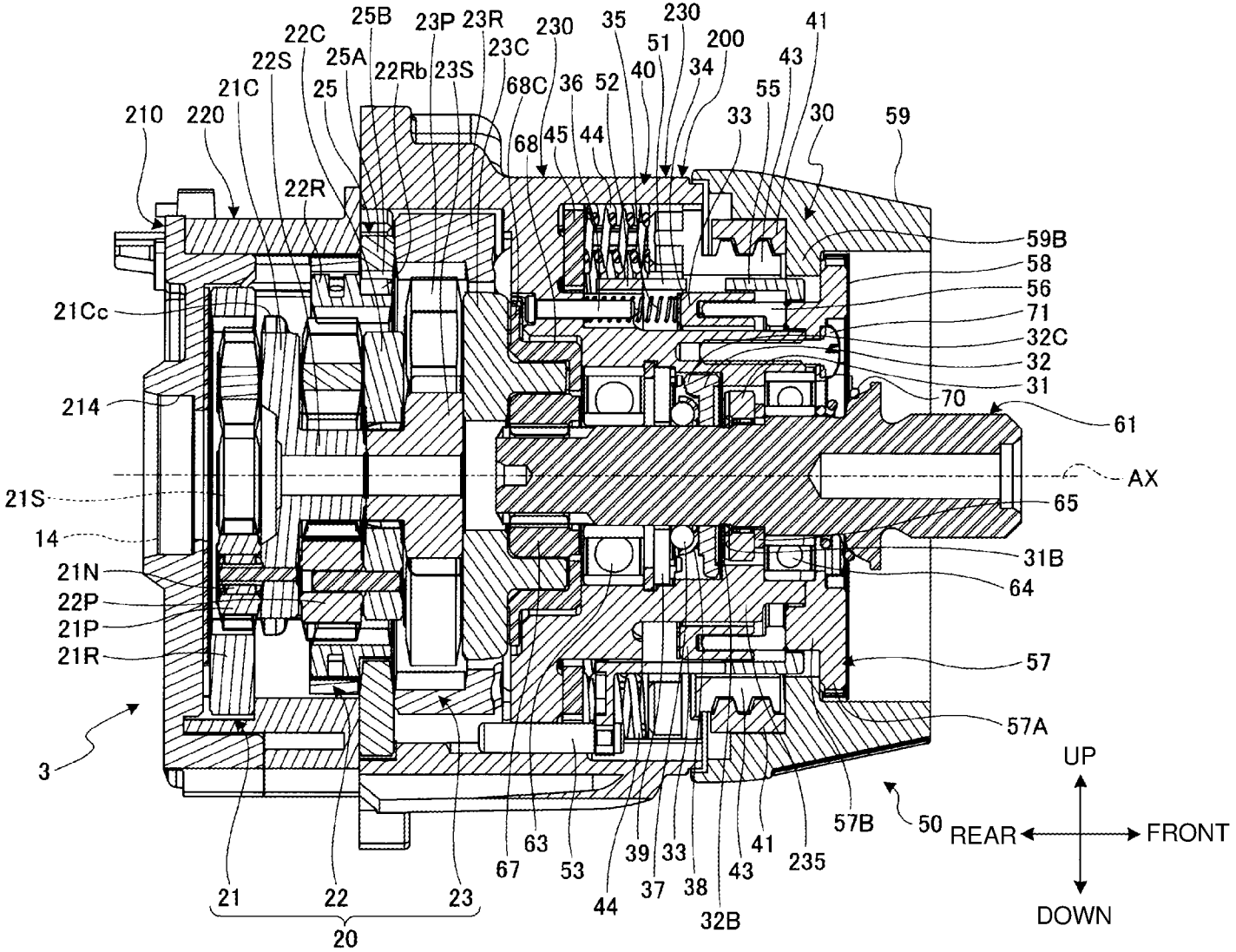
FIG. 12 is a side cross-sectional view of the power transmission mechanism according to the first embodiment.
Figure 13:
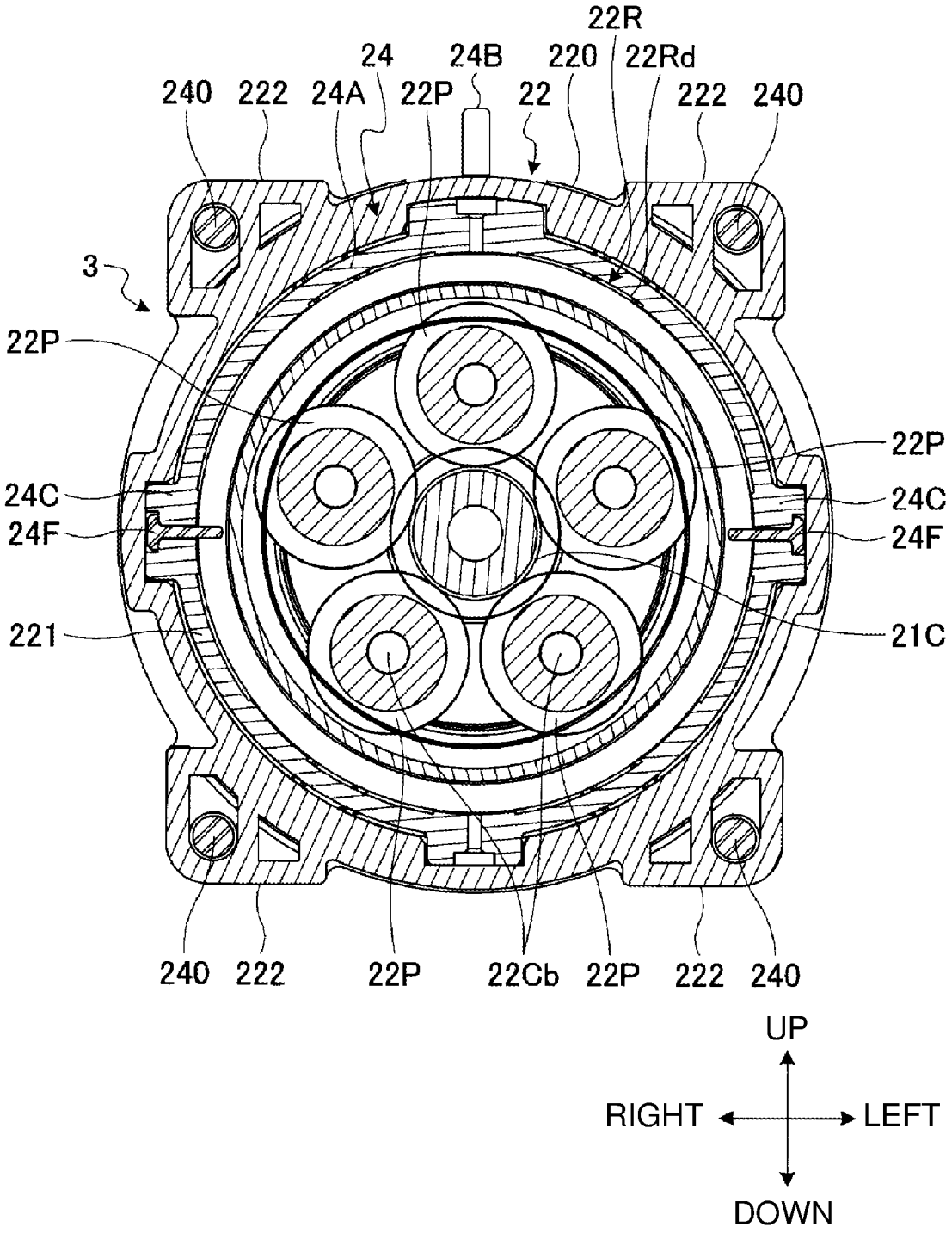
FIG. 13 is a cross-sectional view of the power transmission mechanism according to the first embodiment.

FIG. 11 is a side cross-sectional view of the power transmission mechanism 3 according to the present embodiment, taken along line A-A as viewed in the direction indicated by arrows in FIG. 6. FIG. 12 is a side cross-sectional view of the power transmission mechanism 3 according to the present embodiment, taken along line B-B as viewed in the direction indicated by arrows in FIG. 6. FIG. 13 is a cross-sectional view of the power transmission mechanism 3 according to the present embodiment, taken along line C-C as viewed in the direction indicated by arrows in FIG. 11.

Reduction Mechanism

As shown in FIGS. 11 to 13, the second planetary gear mechanism 22 is located in front of the first planetary gear mechanism 21. The third planetary gear mechanism 23 is located in front of the second planetary gear mechanism 22. The first planetary gear mechanism 21 is at least partially located inside the bracket 210. The second planetary gear mechanism 22 is at least partially located inside the gear case 220. The third planetary gear mechanism 23 is at least partially located inside the gear housing 230. The bearing 14 is received in the hole 214 in the bracket 210.

The speed switch ring 24 at least partially surrounds the second planetary gear mechanism 22. The connection ring 25 is located in front of the speed switch ring 24.

The first planetary gear mechanism 21 includes the multiple planetary gears 21P, the first carrier 21C, and the internal gear 21R. The planetary gears 21P surround the pinion gear 21S. The first carrier 21C supports the planetary gears 21P. The internal gear 21R surrounds the planetary gears 21P.

The protrusions 21Rb on the internal gear 21R are received in the slits 215 in the bracket 210. The protrusions 21Rb received in the slits 215 restrict rotation of the internal gear 21R.

The pins 21Cb on the first carrier 21C rotatably support the planetary gears 21P with the needle bearings 21N in between.

The second planetary gear mechanism 22 includes the sun gear 22S, the multiple planetary gears 22P, the second carrier 22C, and the internal gear 22R. The planetary gears 22P surround the sun gear 22S. The second carrier 22C supports the planetary gears 22P. The internal gear 22R surrounds the planetary gears 22P.

The internal teeth 22Rc on the internal gear 22R mesh with the external teeth 21Cc on the first carrier 21C.

The pins 22Cb on the second carrier 22C rotatably support the planetary gears 22P.

The third planetary gear mechanism 23 includes the sun gear 23S, the multiple planetary gears 23P, the third carrier 23C, and the internal gear 23R. The planetary gears 23P surround the sun gear 23S. The third carrier 23C supports the planetary gears 23P. The internal gear 23R surrounds the planetary gears 23P.

The pins 23Cb on the third carrier 23C rotatably support the planetary gears 23P.

The rotation axis of the rotational shaft 13 corresponds to the rotation axes of the first carrier 21C, the second carrier 22C, and the third carrier 23C.

The speed switch ring 24 is connected to the internal gear 22R and the speed switch lever 28. The ring 24A in the speed switch ring 24 surrounds the internal gear 22R. The protrusions 24C on the speed switch ring 24 are received in the guide grooves 225 on the gear case 220. The guide grooves 225 guide the protrusions 24C in the axial direction. With the protrusions 24C received in the guide grooves 225, the speed switch ring 24, supported by the gear case 220, is movable in the axial direction.

The projection 24E on the speed switch ring 24 is at least partially received in the groove 216 on the bracket 210. The projection 24E at least partially received in the groove 216 positions the bracket 210 and the speed switch ring 24. The projection 24D on the speed switch ring 24 is connected to the speed switch lever 28.

The speed switch ring 24 is connected to the internal gear 22R with the pins 24F. The pins 24F are received in the holes in parts of the ring 24A, with the ring 24A in the speed switch ring 24 surrounding the internal gear 22R. The pins 24F each have a distal end received in the groove 22Rd on the internal gear 22R. This connects the speed switch ring 24 to the internal gear 22R.

The connection ring 25 is located in front of the speed switch ring 24. The connection ring 25 is connected to the speed switch ring 24. The connection ring 25 is fastened to the inner surface of gear case 220.

The ring 25A in the connection ring 25 surrounds the internal gear 22R. The internal teeth 25B on the connection ring 25 mesh with the external teeth 22Rb on the internal gear 22R. Each protrusion 25C on the connection ring 25 is located between the ribs 223 on the gear case 220. Each protrusion 25C is located between the ribs 223 to restrict rotation of the connection ring 25.

The washer 26 is located between the planetary gears 21P in the first planetary gear mechanism 21 and the disk 213 in the bracket 210.

Figure 14:
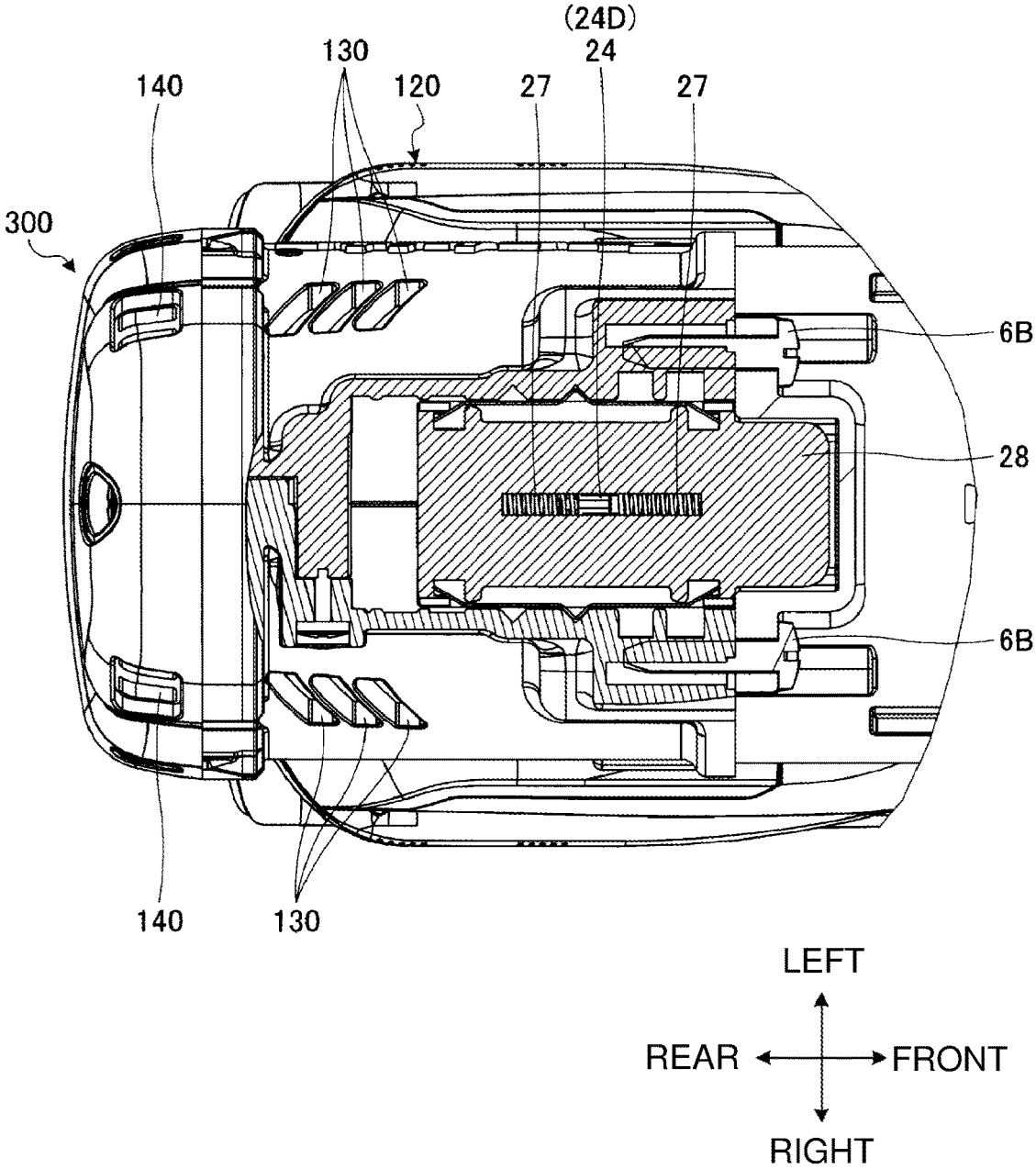
FIG. 14 is a partial cross-sectional view of the power tool according to the first embodiment.

FIG. 14 is a partial cross-sectional view of the power tool 1 according to the present embodiment, taken along line G-G as viewed in the direction indicated by arrows in FIG. 8. As shown in FIGS. 11, 12, and 14, the speed switch lever 28 is connected to the projection 24D on the speed switch ring 24. As shown in FIG. 14, the projection 24D receives coil springs 27 on its front and rear. The speed switch lever 28 is connected to the speed switch ring 24 with the coil springs 27 in between.

The speed switch ring 24 surrounds the internal gear 22R. The speed switch ring 24 is connected to the speed switch lever 28 and the internal gear 22R. The speed switch lever 28 is connected to the internal gear 22R via the speed switch ring 24. The speed switch ring 24, supported by the gear case 220, is movable in the front-rear direction.

As the speed switch lever 28 is operated, the internal gear 22R moves inside the gear housing 230 in the front-rear direction. The internal gear 22R, meshing with the planetary gears 22P, is movable between a first position and a second position rearward from the first position.

The internal gear 22R at the first position is connected to the connection ring 25. At the first position, the internal gear 22R has the external teeth 22Rb meshing with the internal teeth 25B on the connection ring 25. The external teeth 22Rb on the internal gear 22R meshing with the internal teeth 25B on the connection ring 25 restrict rotation of the internal gear 22R. At the first position, the internal gear 22R meshes with the planetary gears 22P.

At the second position, the internal gear 22R is disconnected from the connection ring 25. The internal gear 22R disconnected from the connection ring 25 is rotatable. At the second position, the internal gear 22R is connected to the first carrier 21C. At the second position, the internal gear 22R has the internal teeth 22Rc meshing with the external teeth 21Cc on the first carrier 21C. At the second position, the internal gear 22R thus meshes with both the planetary gears 22P and the first carrier 21C.

When the rotational shaft 13 rotates as driven by the motor 10 with the internal gear 22R at the first position, the pinion gear 21S rotates and the planetary gears 21P revolve about the pinion gear 21S. The revolving planetary gears 21P rotate the first carrier 21C and the sun gear 22S at a rotational speed lower than the rotational speed of the rotational shaft 13. As the sun gear 22S rotates, the planetary gears 22P revolve about the sun gear 22S. The revolving planetary gears 22P rotate the second carrier 22C and the sun gear 23S at a rotational speed lower than the rotational speed of the first carrier 21C. When the motor 10 is driven with the internal gear 22R at the first position, both the first planetary gear mechanism 21 and the second planetary gear mechanism 22 operate for rotation reduction, causing the second carrier 22C and the sun gear 23S to rotate at the first speed.

When the rotational shaft 13 rotates as driven by the motor 10 with the internal gear 22R at the second position, the pinion gear 21S rotates and the planetary gears 21P revolve about the pinion gear 21S. The revolving planetary gears 21P rotate the first carrier 21C and the sun gear 22S at a rotational speed lower than the rotational speed of the rotational shaft 13. At the second position, the internal gear 22R meshes with both the planetary gears 22P and the first carrier 21C and thus rotates together with the first carrier 21C. As the internal gear 22R rotates, the planetary gears 22P revolve at the same revolution speed as the rotational speed of the internal gear 22R. The revolving planetary gears 22P rotate the second carrier 22C and the sun gear 23S at the same rotational speed as the rotational speed of the first carrier 21C. When the motor 10 is driven with the internal gear 22R at the second position, the first planetary gear mechanism 21 operates for rotation reduction without the second planetary gear mechanism 22 operating for rotation reduction, thus causing the second carrier 22C and the sun gear 23S to rotate at the second speed.

As the second carrier 22C and the sun gear 23S rotate, the planetary gears 23P revolve about the sun gear 23S. The revolving planetary gears 23P rotate the third carrier 23C. The spindle 61 in the output mechanism 60 is connected to the third carrier 23C. As the third carrier 23C rotates, the spindle 61 rotates.

Vibration Mechanism

As shown in FIGS. 11 and 12, the first cam 31 is located inside the inner cylinder 235. The first cam 31 surrounds the spindle 61. The first cam 31 is fixed to the spindle 61. The first cam 31 is fastened to the spindle 61 with the circlip 65. The first cam 31 includes the cam teeth 31B on its rear surface.

The second cam 32 is located inside the inner cylinder 235. The second cam 32 is located behind the first cam 31. The second cam 32 surrounds the spindle 61. The second cam 32 is rotatable relative to the spindle 61. The second cam 32 is in contact with the first cam 31. The second cam 32 includes the cam teeth 32B on its front surface. The cam teeth 32B on the second cam 32 mesh with the cam teeth 31B on the first cam 31. The second cam 32 includes the tabs 32C on its rear surface.

The vibration switch lever 33 switches between the vibration mode and the non-vibration mode. In the vibration mode, the spindle 61 vibrates in the axial direction. In the non-vibration mode, the spindle 61 does not vibrate in the axial direction. The vibration switch lever 33 is movable in the front-rear direction. The vibration switch lever 33 moves in the front-rear direction between an advanced position and a retracted position rearward from the advanced position to switch between the vibration mode and the non-vibration mode.

The vibration switch lever 33 is located behind the vibration switch ring 56. The vibration switch lever 33 surrounds the inner cylinder 235. The vibration switch lever 33 includes the tabs 33D protruding radially inward from the rear of the vibration switch lever 33. The tabs 33D are received in the through-holes 238 in the inner cylinder 235. The tabs 33D face the front surface of the second cam 32. The vibration switch lever 33 is arranged on the same cross sectional plane as the first cam 31.

The washer 34 is located behind the vibration switch lever 33. The coil springs 35 are located behind the washer 34. The pins 36 support the coil springs 35. Each pin 36 has a rear end supported by the outer flange 68C on the lock ring 68. The front ends of the coil springs 35 are in contact with the washer 34. The coil springs 35 generate an elastic force for moving the vibration switch lever 33 forward with the washer 34 in between.

The balls 37 and the first holder 38 and the second holder 39 holding the balls 37 are located inside the inner cylinder 235. The first holder 38 is adjacent to the rear surface of the second cam 32. The second holder 39 has the protrusions 39B received in recesses on the inner surface of the inner cylinder 235 and is thus restricted from rotating. The tabs 33D on the vibration switch lever 33 are received in the recesses 39C on the second holder 39.

The change ring 59 is connected to the vibration switch lever 33 via the mode switch mechanism 50. The operator operates the change ring 59 to move the vibration switch lever 33 in the front-rear direction between the advanced position and the retracted position. The change ring 59 is operated to switch the operation mode between the vibration mode and the non-vibration mode.

The vibration mode includes a restricted state of rotation of the second cam 32. The non-vibration mode includes a rotatable state of the second cam 32. When the vibration switch lever 33 moves to the advanced position, the second cam 32 is restricted from rotating. When the vibration switch lever 33 moves to the retracted position, the second cam 32 becomes rotatable.

The change ring 59 is connected to the vibration switch ring 56. The vibration switch ring 56 has the ring 56A received in the grooves 33B in the vibration switch lever 33. The vibration switch ring 56 rotates when the change ring 59 is operated. When the operator rotates the change ring 59 with the vibration switch lever 33 under an elastic force from the coil springs 35, the vibration switch ring 56 rotates. This places the protruding portions 33C located inside the grooves 33B in the vibration switch lever 33 into or out of the recesses 56C on the vibration switch ring 56. The protruding portions 33C on the vibration switch lever 33 are placed into the recesses 56C on the vibration switch ring 56 to move the vibration switch lever 33 to the advanced position. The protruding portions 33C on the vibration switch lever 33 are placed out of the recesses 56C on the vibration switch ring 56 to move the vibration switch lever 33 to the retracted position.

In the vibration mode, the vibration switch lever 33 at the advanced position is at least partially in contact with the second cam 32. In the present embodiment, the tabs 33D on the vibration switch lever 33 at the advanced position are in contact with the tabs 32C on the second cam 32. The vibration switch lever 33 is in contact with the second cam 32 to restrict rotation of the second cam 32. The motor 10 is driven while the second cam 32 is restricted from rotating. The spindle 61 then rotates, with the cam teeth 31B on the first cam 31 fixed to the spindle 61 being in contact with the cam teeth 32B on the second cam 32, which is restricted from rotating. The spindle 61 thus rotates while vibrating in the axial direction.

In the non-vibration mode, the vibration switch lever 33 at the retracted position is apart from the second cam 32. The vibration switch lever 33 apart from the second cam 32 allows the second cam 32 to rotate. When the motor 10 is driven with the second cam 32 being rotatable, the second cam 32 rotates together with the first cam 31 and the spindle 61. The spindle 61 thus rotates without vibrating in the axial direction.

In this manner, the change ring 59 is operated to move the vibration switch lever 33 to the advanced position and to switch the output mechanism 60 to the vibration mode. The change ring 59 is operated to move the vibration switch lever 33 to the retracted position and to switch the output mechanism 60 to the non-vibration mode.

Clutch Mechanism

Figure 15:
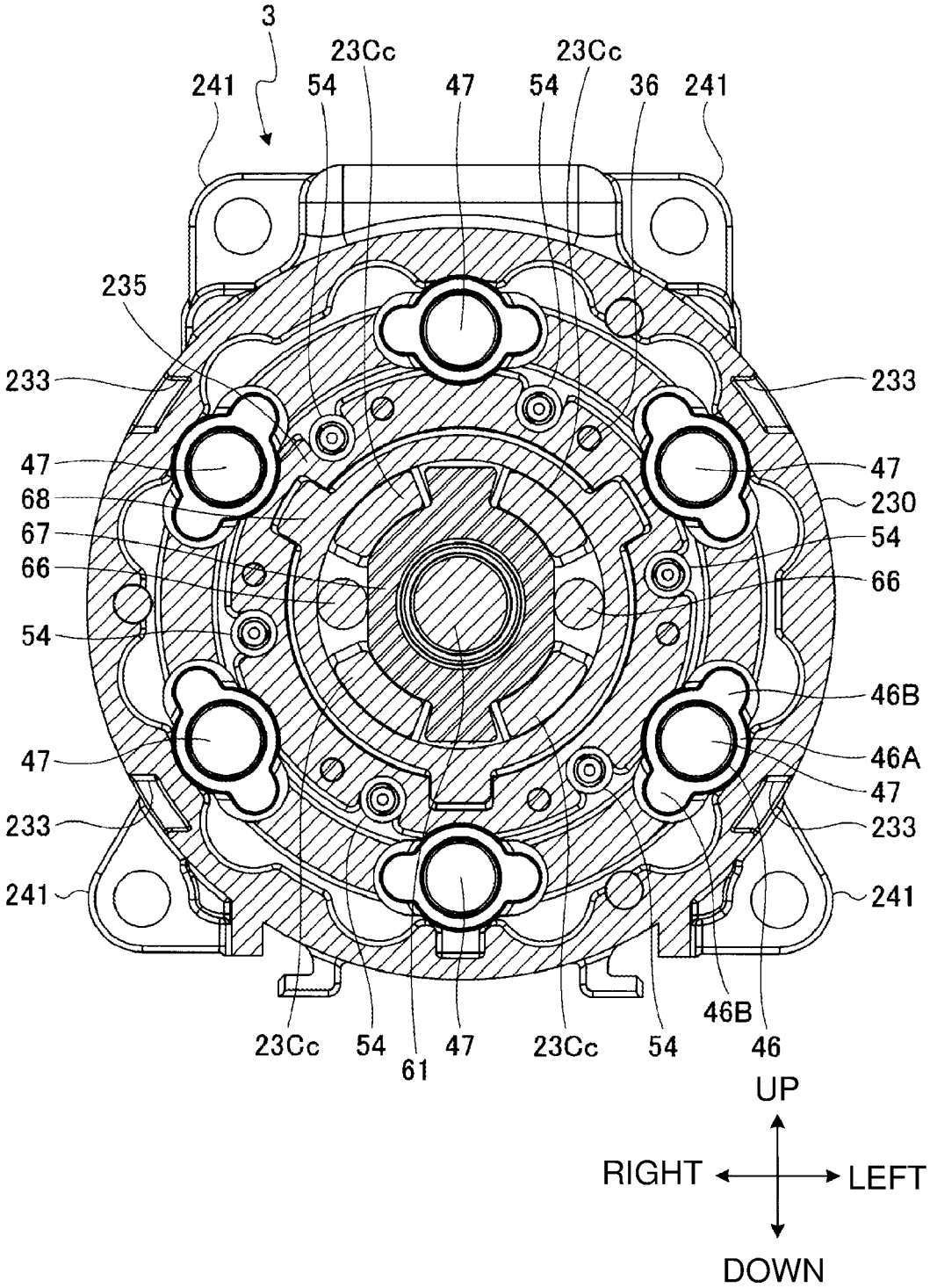
FIG. 15 is a cross-sectional view of the power transmission mechanism according to the first embodiment.
Figure 16:
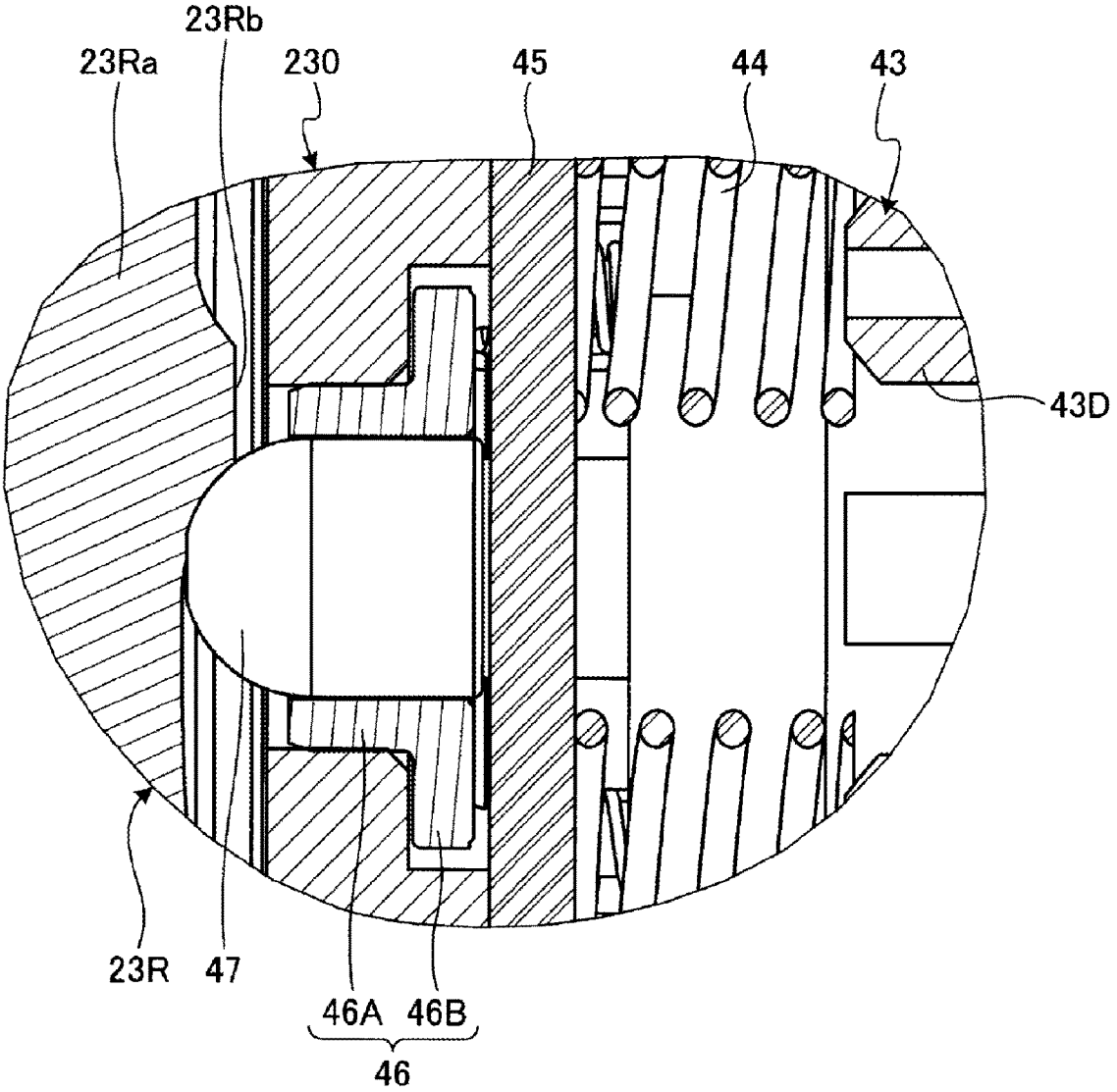
FIG. 16 is a partial cross-sectional view of the power transmission mechanism according to the first embodiment.

FIG. 15 is a cross-sectional view of the power transmission mechanism 3 according to the present embodiment, taken along line D-D as viewed in the direction indicated by arrows in FIG. 11. FIG. 16 is a cross-sectional view of the power transmission mechanism 3 according to the present embodiment, taken along line F-F as viewed in the direction indicated by arrows in FIG. 11.

A shown in FIGS. 11, 12, 15, and 16, the clutch switch ring 41 surrounds the spring holder 43. The clutch switch ring 41 and the spiring holder 43 are arranged on the same cross sectional plane as the first cam 31. The clutch switch ring 41 rotates together with the change ring 59. The change ring 59 is connected to the clutch switch ring 41 via the mode switch mechanism 50. The clutch switch ring 41 is located behind the rib 59B radially inside the change ring 59. The arc plate 41D in the clutch switch ring 41 is received in the recess 59C on the change ring 59. The arc plate 41D is received in the recess 59C on the change ring 59 to restrict rotation of the clutch switch ring 41 relative to the change ring 59. The clutch switch ring 41 rotates together with the change ring 59. The operator operates the change ring 59 to rotate the clutch switch ring 41.

The spring holder 43 holds the coil springs 44. The spring holder 43 is located inside the clutch switch ring 41. The spring holder 43 is movable in the axial direction. The spring holder 43 includes the thread 43B. The thread 43B is fitted with the threaded groove 41B on the clutch switch ring 41. When the operator rotates the change ring 59 to rotate the clutch switch ring 41, the spring holder 43 moves in the axial direction.

The coil springs 44 apply an elastic force to the internal gear 23R in the third planetary gear mechanism 23. The coil springs 44 are held by the spring holding members 43D in the spring holder 43. As shown in FIG. 16, the rear ends of the coil springs 44 are in contact with the washer 45. The front ends of the coil springs 44 are in contact with the support plate 43C in the spring holder 43. The coil springs 44 apply an elastic force to the internal gear 23R through the washer 45 and the clutch pins 47. The coil springs 44 generate an elastic force for moving the washer 45 and the clutch pins 47 rearward.

The spring holder 43 and the coil springs 44 are located between the outer cylinder 231 and the inner cylinder 235. The support plate 43C in the spring holder 43 is received in the recesses 239 on the inner surface of the outer cylinder 231. The support plate 43C is received in the recesses 239 to restrict rotation of the spring holder 43.

The washer 45 is located behind the coil springs 44. The washer 45 is movable in the front-rear direction. The washer 45 is rotatable. The washer 45 surrounds the inner cylinder 235. The washer 45 surrounding the inner cylinder 235 is rotatable and movable in the front-rear direction.

The clutch pin sleeves 46 are in contact with the rear surface of the washer 45. Each clutch pin 47 is located inside the annular portion 46A of the corresponding clutch pin sleeve 46.

The clutch pins 47 are located behind the washer 45. The clutch pins 47 are in contact with the front surface of the internal gear 23R in the third planetary gear mechanism 23. The rear ends of the clutch pins 47 are spherical. The front ends of the clutch pins 47 are in contact with the rear surface of the washer 45. The rear ends of the clutch pins 47 may come in contact with the front surface of the internal gear 23R. The clutch cams 23Rb are located on the front surface of the internal gear 23R. The rear ends of the clutch pins 47 are engageable with the clutch cams 23Rb in the internal gear 23R.

The coil springs 44 apply an elastic force to the internal gear 23R through the washer 45 and the clutch pins 47. The coil springs 44 generate an elastic force for moving the washer 45 and the clutch pins 47 rearward.

As shown in FIG. 15, the lock cam 67 surrounds the spindle 61. The lock ring 68 surrounds the lock cam 67. The protrusions 23Cc on the third carrier 23C are located in a space between the lock cam 67 and the lock ring 68. The rollers 66 are located between a pair of protrusions 23Cc. The inner cylinder 235 surrounds the lock ring 68. The clutch pins 47 surround the inner cylinder 235.

An elastic force from the coil springs 44 is transmitted to the internal gear 23R through the washer 45 and the clutch pins 47. The coil springs 44 generate an elastic force for urging the clutch pins 47 against the front surface of the internal gear 23R. The clutch pins 47 are urged against the internal gear 23R to restrict rotation of the internal gear 23R. In other words, the internal gear 23R is restricted from rotating under an elastic force from the coil springs 44.

The clutch pins 47 are urged against the internal gear 23R to cause engagement between the clutch cams 23Rb in the internal gear 23R and the clutch pins 47.

When the rotation load on the output mechanism 60 is smaller than the elastic force applied to the internal gear 23R by the coil springs 44, the clutch pins 47 cannot move over the clutch cams 23Rb and remain engaged with the clutch cams 23Rb. The clutch pins 47 and the clutch cams 23Rb are engaged with each other to restrict rotation of the internal gear 23R. When the motor 10 is driven with the internal gear 23R being restricted from rotating, the spindle 61 rotates.

When the rotation load on the output mechanism 60 exceeds the elastic force applied to the internal gear 23R by the coil springs 44, the clutch pins 47 move over the clutch cams 23Rb and are disengaged from the clutch cams 23Rb. The clutch pins 47 and the clutch cams 23Rb are disengaged from each other to allow rotation of the internal gear 23R. When the motor 10 is driven with the internal gear 23R being rotatable, the internal gear 23R rotates without engagement, and thus without causing rotation of the spindle 61.

As described above, when the rotation load on the output mechanism 60 is smaller than the elastic force applied to the internal gear 23R by the coil springs 44, the internal gear 23R despite being in a rotatable state is restricted from rotating under the elastic force from the coil springs 44. When the rotation load on the output mechanism 60 exceeds the elastic force applied to the internal gear 23R by the coil springs 44, the internal gear 23R in a rotatable state rotates without engagement. This disables power transmission from the motor 10 to the output mechanism 60.

The change ring 59 is operated to move the spring holder 43 in the front-rear direction. The spring holder 43 moves to change the length (compression amount) of the coil springs 44. More specifically, the spring holder 43 moves to change the elastic force applied from the coil springs 44 and thus to change the elastic force applied to the internal gear 23R. The release value is then set for disabling power transmission to the output mechanism 60.

Mode Switch Mechanism

As shown in FIGS. 11 and 12, the support ring 51 is located radially inside the spring holder 43. The vibration switch lever 33 is located inside the support ring 51. The pin holder 52 is located behind the support ring 51. The pin holder 52 is movable in the front-rear direction.

The lock pins 53 restrict rotation of the internal gear 23R in the third planetary gear mechanism 23. The lock pins 53 are held by the pin holding members 52D in the pin holder 52. The pin holding members 52D hold the front ends of the lock pins 53. The lock pins 53 move in the axial direction as the pin holder 52 moves in the axial direction. The lock pins 53 move in the axial direction to switch between the restricted state of rotation of the internal gear 23R and the rotatable state of the internal gear 23R. When the lock pins 53 move rearward, the rear ends of the lock pins 53 are placed between the protrusions 23Rc on the internal gear 23R, restricting rotation of the internal gear 23R. When the lock pins 53 move forward, the lock pins 53 are removed from between the protrusions 23Rc on the internal gear 23R, allowing rotation of the internal gear 23R.

The coil springs 54 are held by the spring holding members 52C in the pin holder 52. The coil springs 54 generate an elastic force for moving the pin holder 52 forward.

The drill switch ring 55 is located in front of the support ring 51. The drill switch ring 55 is located radially inside the change ring 59 and the spring holder 43.

The vibration switch ring 56 is located in front of the vibration switch lever 33. The vibration switch ring 56 is located inside the drill switch ring 55.

The drill switch ring 55 and the vibration switch ring 56 rotate together. The protrusions 55D on the drill switch ring 55 are received in the recesses 56B on the vibration switch ring 56. The protrusions 55D received in the recesses 56B restrict the drill switch ring 55 from rotating relative to the vibration switch ring 56. The vibration switch ring 56 rotates together with the drill switch ring 55.

The cam plate 57 is fastened to the inner cylinder 235 with the screws 71. The screws 71 are received in the screw holes 237 in the inner cylinder 235. The cam plate 57 is located in front of the rib 59B on the change ring 59.

The cover ring 58 surrounds the front cam plate 57A in the cam plate 57. The protruding portion 58B on the cover ring 58 is received in the recess 59C on the change ring 59. This restricts the cover ring 58 from rotating relative to the change ring 59. The cover ring 58 rotates together with the change ring 59.

The cover ring 58 received in the recess 59C on the change ring 59 reduces foreign matter entering the change ring 59 and the internal space of the casing 200. The cover ring 58 serves as a dustproof member.

The change ring 59 surrounds the inner cylinder 235. The change ring 59 is connected to the clutch switch ring 41. The change ring 59 is rotatable about the rotation axis AX.

Figure 17:
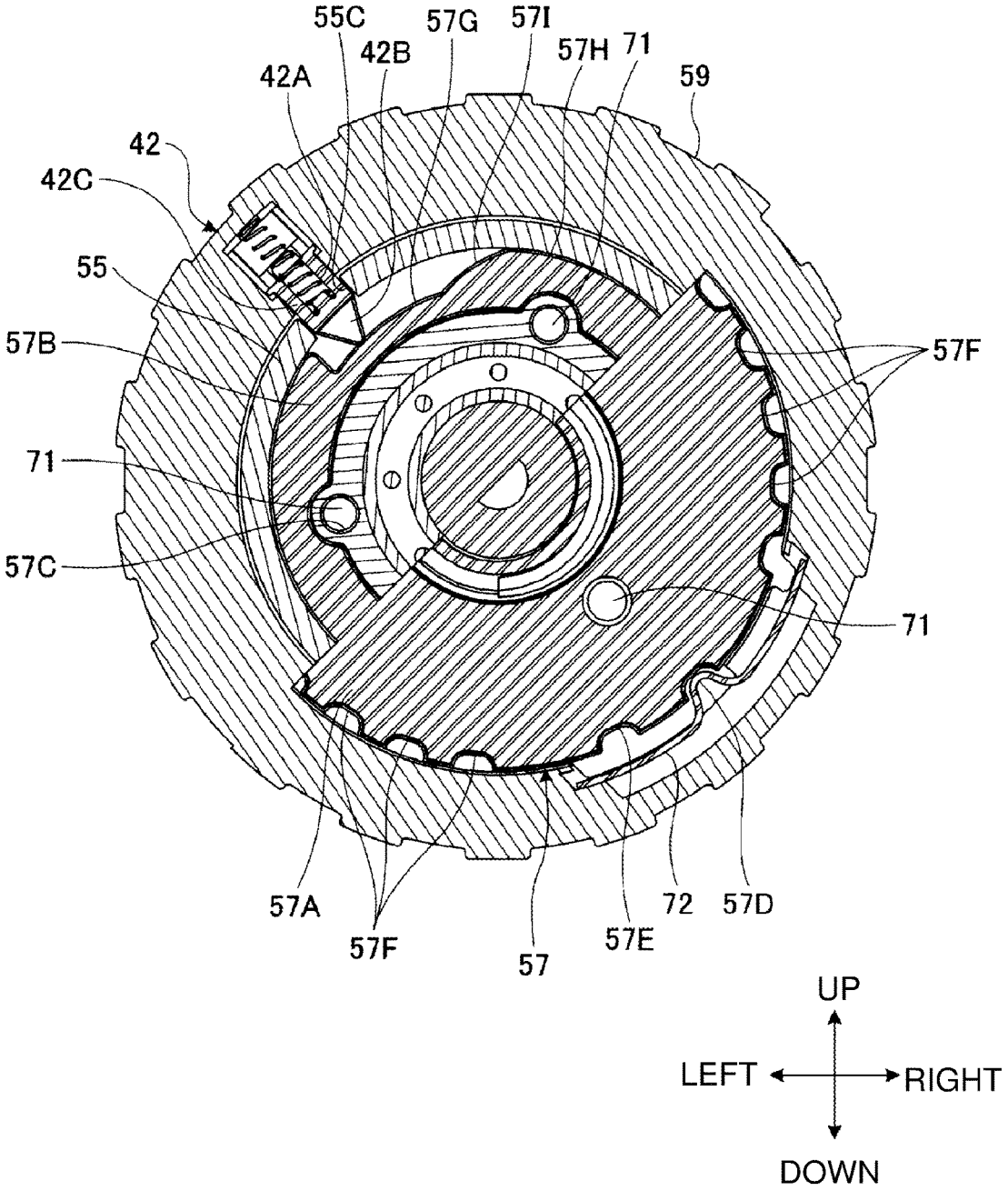
FIG. 17 is a cross-sectional view of the power transmission mechanism according to the first embodiment.

FIG. 17 is a cross-sectional view of the power transmission mechanism 3 according to the present embodiment, taken along line E-E as viewed in the direction indicated by arrows in FIG. 11. As shown in FIG. 17, the front cam plate 57A has the notch 57D, the notch 57E, and the multiple notches 57F. The middle portion of the leaf spring 72 is received in at least one of the notches 57D, 57E, and 57F.

The rear cam plate 57B includes a smaller-diameter portion 57G, a larger-diameter portion 57H, and a slope 571. The slope 571 connects the smaller-diameter portion 57G and the larger-diameter portion 57H. The follower 42B in the lock lever 42 is in contact with the circumference of the rear cam plate 57B. The lock lever 42 is at least partially received in the recess 55C on the drill switch ring 55.

The lock lever 42 is partially held by the lock lever holder 41C in the clutch switch ring 41. The lock lever 42 is partially received in a hole in the change ring 59.

The distal end of the lock lever 42 is in contact with the rear cam plate 57B. The spring 42C generates an elastic force for moving the lock lever 42 radially inward. When the rear cam plate 57B rotates, the follower 42B, in contact with the circumference of the rear cam plate 57B, moves radially.

Output Mechanism

The spindle 61 is connected to the third carrier 23C. As the third carrier 23C rotates, the spindle 61 rotates.

The spindle 61 is rotatably supported by the bearings 63 and 64. The spindle 61, supported by the bearings 63 and 64, is movable in the front-rear direction.

The chuck 62 is connected to the front of the spindle 61. The chuck 62 holds the tip tool. The chuck 62 rotates as the spindle 61 rotates. The chuck 62 rotates while holding the tip tool.

The bearing 64 is located outside the front step 61B in the spindle 61. The coil spring 70 is located between the bearing 64 and the flange 61A. The coil spring 70 generates an elastic force urging the circlip 65 against the bearing 64.

As shown in FIG. 15, the lock cam 67 surrounds the spindle 61. The rear step 61D of the spindle 61 is connected in the hole in the annular portion 67A of the lock cam 67 with the splines. The spindle 61, the lock cam 67, and the third carrier 23C rotate together.

The clip 69 presses the bearing 63. The clip 69 is supported in a groove on the inner surface of the inner cylinder 235 in the gear housing 230.

Switching of Operation Modes

The change ring 59 is operated to change the operation mode of the power tool 1. The operation mode includes the vibration mode, the drill mode, and the clutch mode.

In the vibration mode, the output mechanism 60 vibrates in the front-rear direction and the clutch mechanism 40 does not disable power transmission. For example, the vibration mode is selected for cutting a hole in a workpiece with the tip tool.

In the drill mode, the output mechanism 60 does not vibrate in the front-rear direction and the clutch mechanism 40 does not disable power transmission. For example, the vibration mode is selected for cutting a hole in a workpiece with the tip tool. The drill mode is included in the non-vibration mode.

In the clutch mode, the output mechanism 60 does not vibrate in the front-rear direction and the clutch mechanism 40 disables power transmission. For example, the clutch mode is selected for fastening a screw into a workpiece with the tip tool. The clutch mode is included in the non-vibration mode.

To set the vibration mode, the operator rotates the change ring 59 to a first rotational position. At the first rotational position, the middle portion of the leaf spring 72 is received in the notch 57D. At the first rotational position, the follower 42B in the lock lever 42 is in contact with the smaller-diameter portion 57G of the rear cam plate 57B.

When the change ring 59 is at the first rotational position, the drill switch ring 55 and the vibration switch ring 56 are also at the first rotational position. When the change ring 59 is at the first rotational position, the base 42A in the lock lever 42 is received in the recess 55C on the drill switch ring 55. The change ring 59 is thus connected to the drill switch ring 55 via the lock lever 42. The drill switch ring 55 rotates together with the change ring 59.

The change ring 59, connected to the drill switch ring 55 via the lock lever 42, is operated to rotate the drill switch ring 55 and the vibration switch ring 56. When the change ring 59 is at the first rotational position, the drill switch ring 55 and the vibration switch ring 56 are at the first rotational position.

When the drill switch ring 55 is at the first rotational position, the rear end of the ring 55A in the drill switch ring 55 comes in contact with the front ends of the cam projections 51B on the support ring 51. The ring 55A in contact with the cam projections 51B moves the support ring 51 rearward.

The pin holder 52 moves rearward as the support ring 51 moves rearward. When the pin holder 52 moves rearward, the lock pins 53 are placed between the protrusions 23Rc on the internal gear 23R. This restricts rotation of the internal gear 23R. The internal gear 23R is restricted from rotating, and thus the clutch mechanism 40 is not operable.

When the vibration switch ring 56 is rotated to the first rotational position with the vibration switch lever 33 under an elastic force from the coil springs 35, the protruding portions 33C inside the grooves 33B in the vibration switch lever 33 are received in the recesses 56C on the vibration switch ring 56. This causes the vibration switch lever 33 to move to the advanced position. When the vibration switch lever 33 moves to the advanced position, the tabs 33D on the vibration switch lever 33 are placed between the tabs 32C on the second cam 32. This restricts rotation of the second cam 32.

With the second cam 32 restricted from rotating, the spindle 61 rotates while the cam teeth 31B on the first cam 31 fixed to the spindle 61 are in contact with the cam teeth 32B on the second cam 32, which is restricted from rotating. The spindle 61 thus rotates while vibrating in the axial direction.

To set the drill mode, the operator rotates the change ring 59 to a second rotational position. At the second rotational position, the middle portion of the leaf spring 72 is received in the notch 57E. At the second rotational position, the follower 42B in the lock lever 42 is in contact with the interface between the smaller-diameter portion 57G and the slope 571 of the rear cam plate 57B.

When the change ring 59 is at the second rotational position, the drill switch ring 55 and the vibration switch ring 56 are also at the second rotational position. When the change ring 59 is at the second rotational position, the base 42A in the lock lever 42 is received in the recess 55C on the drill switch ring 55. The change ring 59 is thus connected to the drill switch ring 55 via the lock lever 42. The drill switch ring 55 rotates together with the change ring 59.

The change ring 59, connected to the drill switch ring 55 via the lock lever 42, is operated to rotate the drill switch ring 55 and the vibration switch ring 56. When the change ring 59 is at the second rotational position, the drill switch ring 55 and the vibration switch ring 56 are at the second rotational position.

When the drill switch ring 55 is at the second rotational position, the rear end of the ring 55A in the drill switch ring 55 comes in contact with the front ends of the cam projections 51B on the support ring 51. The ring 55A in contact with the cam projections 51B moves the support ring 51 rearward.

The pin holder 52 moves rearward as the support ring 51 moves rearward. When the pin holder 52 moves rearward, the lock pins 53 are placed between the protrusions 23Rc on the internal gear 23R. This restricts rotation of the internal gear 23R. The internal gear 23R is restricted from rotating, and thus the clutch mechanism 40 is not operable.

When the vibration switch ring 56 is rotated to the second rotational position with the vibration switch lever 33 under an elastic force from the coil springs 35, the protruding portions 33C inside the grooves 33B in the vibration switch lever 33 are located outside the recesses 56C on the vibration switch ring 56 and come in contact with the rear end of the ring 56A. This causes the vibration switch lever 33 to move to the retracted position. The vibration switch lever 33 at the retracted position is apart from the second cam 32, and the tabs 33D on the vibration switch lever 33 are disengaged from the tabs 32C on the second cam 32. This allows rotation of the second cam 32.

With the second cam 32 being rotatable, the spindle 61 rotates while the cam teeth 31B on the first cam 31 fixed to the spindle 61 are meshing with the cam teeth 32B on the second cam 32, which is rotatable. In other words, the second cam 32 rotates together with the first cam 31 and the spindle 61. The spindle 61 thus rotates without vibrating in the axial direction.

To set the clutch mode, the operator rotates the change ring 59 to a third rotational position. At the third rotational position, the middle portion of the leaf spring 72 is received in one of the notches 57F. At the third rotational position, the follower 42B in the lock lever 42 is in contact with the larger-diameter portion 57H.

When the change ring 59 is at the third rotational position, the drill switch ring 55 and the vibration switch ring 56 are also at the third rotational position. When the change ring 59 is at the third rotational position, the base 42A in the lock lever 42 is removed from the recess 55C on the drill switch ring 55. The change ring 59 is thus disconnected from the drill switch ring 55. The drill switch ring 55 thus does not rotate together with the change ring 59.

When the drill switch ring 55 is at the third rotational position, the cam projections 51B on the support ring 51 are received in the cam recesses 55B on the drill switch ring 55. The cam projections 51B received in the cam recesses 55B move the support ring 51 forward.

The pin holder 52 moves forward as the support ring 51 moves forward. When the pin holder 52 moves forward, the lock pins 53 are removed from between the protrusions 23Rc on the internal gear 23R. This allows rotation of the internal gear 23R. The internal gear 23R becomes rotatable to cause the clutch mechanism 40 to be operable.

When the vibration switch ring 56 is rotated to the third rotational position with the vibration switch lever 33 under an elastic force from the coil springs 35, the protruding portions 33C inside the grooves 33B in the vibration switch lever 33 are located outside the recesses 56C on the vibration switch ring 56 and come in contact with the rear end of the ring 56A. This causes the vibration switch lever 33 to move to the retracted position. The vibration switch lever 33 at the retracted position is apart from the second cam 32, and the tabs 33D on the vibration switch lever 33 are disengaged from the tabs 32C on the second cam 32. This allows rotation of the second cam 32.

With the second cam 32 being rotatable, the spindle 61 rotates while the cam teeth 31B on the first cam 31 fixed to the spindle 61 are meshing with the cam teeth 32B on the second cam 32, which is rotatable. In other words, the second cam 32 rotates together with the first cam 31 and the spindle 61. The spindle 61 thus rotates without vibrating in the axial direction.

The clutch pins 47 are engaged with the clutch cams 23Rb in the internal gear 23R while the internal gear 23R is rotatable. The clutch pins 47 are urged against the clutch cams 23Rb in the internal gear 23R under an elastic force from the coil springs 44.

When the rotation load on the output mechanism 60 is smaller than the elastic force from the coil springs 44 applied to the internal gear 23R that is driven to rotate by the motor 10, the clutch pins 47 cannot move over the clutch cams 23Rb and remain engaged with the clutch cams 23Rb. The clutch pins 47 and the clutch cams 23Rb are engaged with each other to restrict rotation of the internal gear 23R. When the motor 10 is driven with the internal gear 23R being restricted from rotating, the output mechanism 60 rotates.

When the rotation load on the output mechanism 60 exceeds the elastic force applied to the internal gear 23R by the coil springs 44, the clutch pins 47 move over the clutch cams 23Rb and are disengaged from the clutch cams 23Rb. The clutch pins 47 and the clutch cams 23Rb are disengaged from each other to allow rotation of the internal gear 23R. When the motor 10 is driven with the internal gear 23R being rotatable, the internal gear 23R rotates without engagement, disabling power transmission to the output mechanism 60. The output mechanism 60 thus does not rotate.

As described above, the base 42A in the lock lever 42 is removed from the recess 55C on the drill switch ring 55 in the clutch mode. The drill switch ring 55 does not rotate when the change ring 59 is operated. The change ring 59 is operated to rotate the larger-diameter portion 57H of the rear cam plate 57B with the follower 42B in the lock lever 42 in contact with the larger-diameter portion 57H. The change ring 59 is operated to rotate the clutch switch ring 41 together with the change ring 59. The threaded groove 41B on the clutch switch ring 41 is fitted with the thread 43B on the spring holder 43. When the change ring 59 rotates and thus the clutch switch ring 41 rotates, the spring holder 43 moves in the axial direction. As described above, the spring holder 43 moves in the front-rear direction to change the length (compression amount) of the coil springs 44. More specifically, the spring holder 43 moves to change the elastic force from the coil springs 44 and thus to change the elastic force applied to the internal gear 23R. The release value is then set for disabling power transmission to the output mechanism 60.

The release value is adjustable based on the amount of rotation of the change ring 59. The operator can adjust the release value by rotating the change ring 59 to select one of the notches 57F to receive the middle portion of the leaf spring 72. Three notches 57F are used in the present embodiment. The operator can adjust the rotation amounts of the change ring 59 and the clutch switch ring 41 to allow the middle portion of the leaf spring 72 to be received in the first notch 57F. This sets the release value to a first release value for disabling power transmission to the output mechanism 60. Similarly, the middle portion of the leaf spring 72 is received in the second notch 57F to set the release value to a second release value. The middle portion of the leaf spring 72 is received in the third notch 57F to set the release value to a third release value.

Operation

An example operation of the power tool 1 according to the present embodiment will now be described. The battery pack 7 is attached to the battery mount 2 to power the power tool 1. In the power tool 1 powered by the battery pack 7, the trigger 17A is operated to cause the switch circuit 17B to output an operation signal. The controller 4 supplies a current to the motor 10 in response to the operation signal output from the switch circuit 17B. This rotates the rotational shaft 13.

As the rotational shaft 13 rotates, the spindle 61 rotates via the power transmission mechanism 3. As the spindle 61 rotates, the chuck 62 rotates. As the chuck 62 rotates, the tip tool attached to the chuck 62 rotates.

As the rotational shaft 13 rotates, the centrifugal fan 16 rotates. As the centrifugal fan 16 rotates, air flows around the motor 10. The air flowing around the motor 10 cools the motor 10. The air flowing around the motor 10 is discharged through the outlets 140.

Spindle and First Cam

Figure 18:
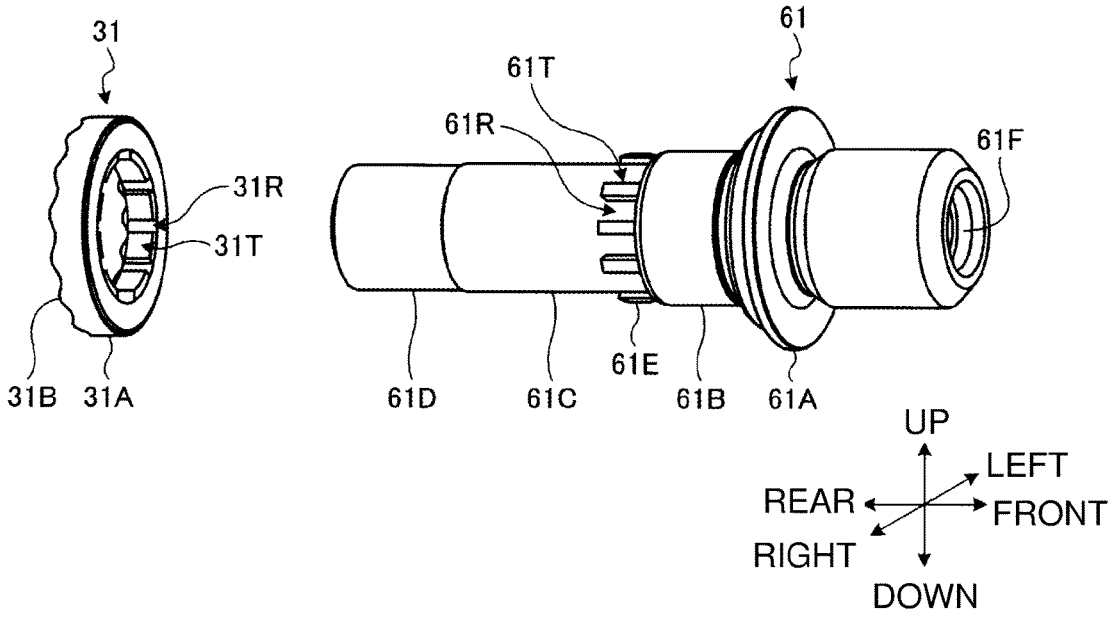
FIG. 18 is a perspective view of a spindle and a first cam according to the first embodiment.
Figure 19:
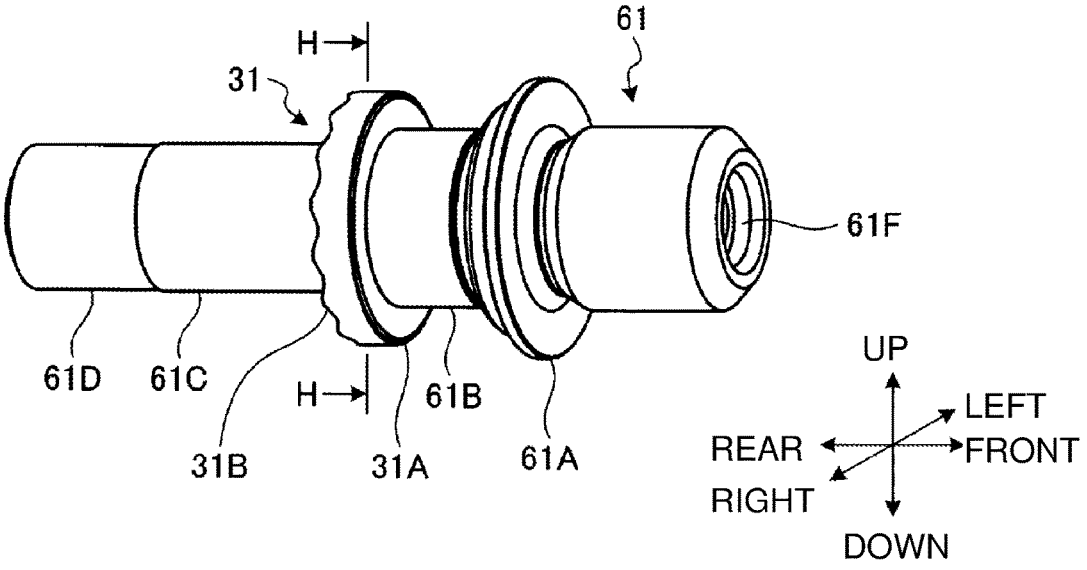
FIG. 19 is a perspective view of the spindle and the first cam according to the first embodiment.
Figure 20:
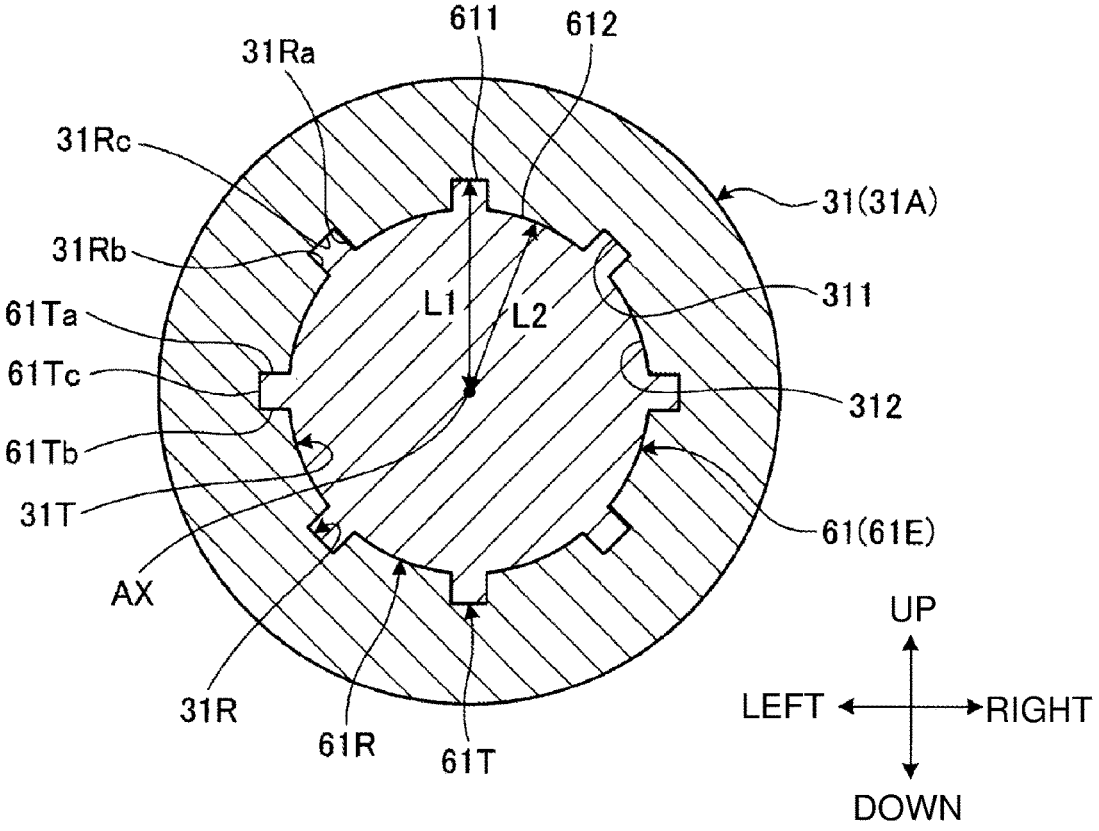
FIG. 20 is a cross-sectional view of the spindle and the first cam according to the first embodiment.

FIGS. 18 and 19 are perspective views of the spindle 61 and the first cam 31 according to the present embodiment. FIG. 19 shows the spindle 61 receiving the first cam 31. FIG. 20 is a cross-sectional view of the spindle 61 and the first cam 31 according to the present embodiment. FIG. 20 is a cross-sectional view taken along line H-H as viewed in the direction indicated by arrows in FIG. 19.

The spindle 61 includes the flange 61A, the front step 61B, the middle step 61C, the rear step 61D, the attachment portion 61E, and the spindle hole 61F. The front step 61B is located behind the flange 61A. The front step 61B has a smaller outer diameter than the flange 61A. The middle step 61C is located behind the front step 61B. The middle step 61C has a smaller outer diameter than the front step 61B. The rear step 61D is located behind the middle step 61C. The rear step 61D has a smaller outer diameter than the middle step 61C. The attachment portion 61E is located between the front step 61B and the middle step 61C in the axial direction. The spindle hole 61F is located in the front end of the spindle 61. The spindle hole 61F has a threaded groove on its inner surface.

The first cam 31 surrounds the spindle 61. The first cam 31 according to the present embodiment surrounds the attachment portion 61E of the spindle 61. The first cam 31 is attached to the attachment portion 61E. The outer surface of the attachment portion 61E of the spindle 61 faces the inner surface of the ring 31A in the first cam 31. The outer surface of the attachment portion 61E is at least partially in contact with the inner surface of the ring 31A.

The attachment portion 61E of the spindle 61 includes first portions 611 and second portions 612 on its outer surface. In a cross section orthogonal to the rotation axis AX, a distance between the rotation axis AX and each first portion 611 is a first distance L1. In a cross section orthogonal to the rotation axis AX, a distance between the rotation axis AX and each second portion 612 is a second distance L2. The first distance L1 is different from the second distance L2. In the present embodiment, the first distance L1 is longer than the second distance L2.

The ring 31A in the first cam 31 includes third portions 311 and fourth portions 312 on its inner surface. The third portions 311 are engaged with the first portions 611. The fourth portions 312 are engaged with the second portions 612.

In the present embodiment, the third portions 311 are in contact with the first portions 611. The fourth portions 312 are in contact with the second portions 612. The third portions 311 may be at least partially separate from the first portions 611. The fourth portions 312 may be at least partially separate from the second portions 612.

The first portions 611 are located circumferentially at intervals about the rotation axis AX. The third portions 311 are located circumferentially at intervals about the rotation axis AX in a manner engageable with the first portions 611.

The second portions 612 are located circumferentially at intervals about the rotation axis AX. The fourth portions 312 are located circumferentially at intervals about the rotation axis AX in a manner engageable with the second portions 612.

The first portions 611 according to the present embodiment are located circumferentially at equal intervals about the rotation axis AX. Each second portion 612 is located between circumferentially adjacent first portions 611 about the rotation axis AX. The second portions 612 are located circumferentially at equal intervals about the rotation axis AX.

The third portions 311 are located circumferentially at equal intervals about the rotation axis AX. Each fourth portion 312 is located between circumferentially adjacent third portions 311 about the rotation axis AX. The fourth portions 312 are located circumferentially at equal intervals about the rotation axis AX.

In the present embodiment, each first portion 611 includes a surface portion of the corresponding protrusion 61T on the attachment portion 61E of the spindle 61. The protrusions 61T are located circumferentially at intervals about the rotation axis AX. In the present embodiment, eight protrusions 61T are used. The protrusions 61T are located circumferentially at equal intervals about the rotation axis AX. Each second portion 612 includes an inner surface portion of the corresponding recess 61R between circumferentially adjacent protrusions 61T about the rotation axis AX on the attachment portion 61E.

In the present embodiment, each third portion 311 includes an inner surface portion of the corresponding recess 31R on the ring 31A in the first cam 31. The recesses 31R are located circumferentially at intervals about the rotation axis AX. In the present embodiment, eight recesses 31R are used. The recesses 31R are located circumferentially at equal intervals about the rotation axis AX. Each fourth portion 312 includes a surface portion of the corresponding protrusion 31T between circumferentially adjacent recesses 31R about the rotation axis AX on the ring 31A.

The protrusions 61T are fitted in the recesses 31R. The protrusions 31T are fitted in the recesses 61R. In a cross section orthogonal to the rotation axis AX, each protrusion 61T has a first side surface 61Ta, a second side surface 61Tb, and an outer end surface 61Tc. The first side surface 61Ta extends radially about the rotation axis AX. The second side surface 61Tb extends radially about the rotation axis AX. The outer end surface 61Tc connects the outer end of the first side surface 61Ta and the outer end of the second side surface 61Tb.

Each recess 31R has a first contact surface 31Ra, a second contact surface 31Rb, and a third contact surface 31Rc. The first contact surface 31Ra is in contact with the first side surface 61Ta. The second contact surface 31Rb is in contact with the second side surface 61Tb. The third contact surface 31Rc is in contact with the outer end surface 61Tc.

Effects

As described above, the spindle 61 according to the present embodiment has, on its outer surface, the first portions 611 at the first distance L1 from the rotation axis AX and the second portions 612 at the second distance L2 from the rotation axis AX in a cross section orthogonal to the rotation axis AX. The first cam 31 includes, on its inner surface, the third portions 311 engaged with the first portions 611 and the fourth portions 312 engaged with the second portions 612. This structure reduces rotation of the spindle 61 relative to the first cam 31.

When the first cam 31 is insufficiently fixed to the spindle 61, the spindle 61 may rotate relative to the first cam 31 in the vibration mode. In this case, when the spindle 61 rotates with the first cam 31 in contact with the second cam 32, the first cam 31 may be nonrotatable relative to the second cam 32. When the first cam 31 is nonrotatable relative to the second cam 32 in the vibration mode, the spindle 61 may vibrate insufficiently.

When, for example, the attachment portion 61E of the spindle 61 has a circular profile and the ring 31A in the first cam 31 has a circular opening in a cross section orthogonal to the rotation axis AX, a frictional force between the outer surface of the spindle 61 and the inner surface of the first cam 31 reduces rotation of the spindle 61 relative to the first cam 31. To reduce its axial dimensions, the power tool 1 may include a first cam 31 smaller in the axial direction with a smaller area of contact between the outer surface of the spindle 61 and the inner surface of the first cam 31. This structure may generate a smaller frictional force between the outer surface of the spindle 61 and the inner surface of the first cam 31, increasing the likelihood that the spindle 61 rotates relative to the first cam 31 in the vibration mode.

In the present embodiment, the spindle 61 includes the first portions 611 and the second portions 612 on its outer surface, and the first cam 31 includes the third portions 311 and the fourth portions 312 on its inner surface. This structure allows the attachment portion 61E of the spindle 61 to mesh with the ring 31A in the first cam 31. The first cam 31 smaller in the axial direction can thus reduce rotation of the spindle 61 relative to the first cam 31 in the vibration mode.

In the present embodiment, eight protrusions 61T are used. In some embodiments, three or more protrusions 61T may be used. The protrusions 61T may be located circumferentially at equal or unequal intervals about the rotation axis AX.

Second Embodiment

A second embodiment will now be described. The same or corresponding components as those in the above embodiment are given the same reference numerals herein, and will be described briefly or will not be described.

Figure 21:
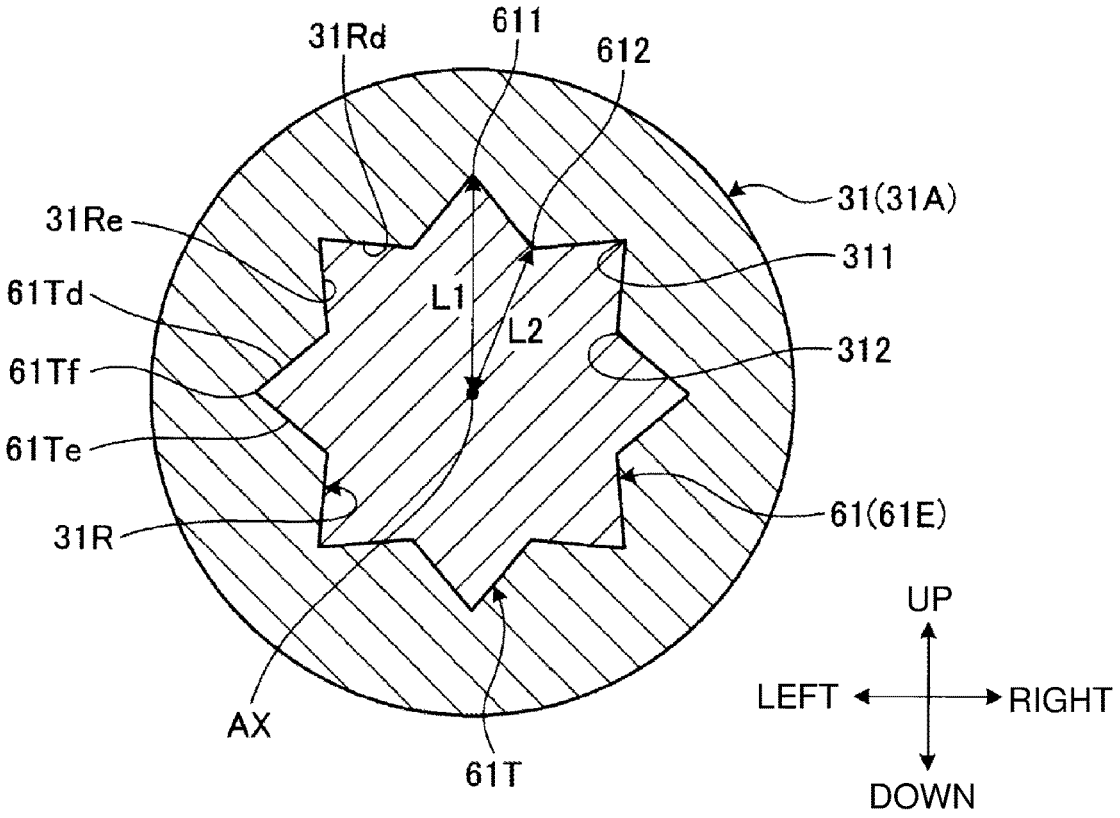
FIG. 21 is a cross-sectional view of a spindle and a first cam according to a second embodiment.

FIG. 21 is a cross-sectional view of a spindle 61 and a first cam 31 according to the present embodiment. As shown in FIG. 21, the spindle 61 includes first portions 611 and second portions 612 on its outer surface. In a cross section orthogonal to the rotation axis AX, a distance between the rotation axis AX and each first portion 611 is a first distance L1. In a cross section orthogonal to the rotation axis AX, a distance between the rotation axis AX and each second portion 612 is a second distance L2.

The first cam 31 includes third portions 311 and fourth portions 312 on its inner surface. The third portions 311 are engaged with the first portions 611. The fourth portions 312 are engaged with the second portions 612.

The first portions 611 are located circumferentially at equal intervals about the rotation axis AX. Each second portion 612 is located between circumferentially adjacent first portions 611 about the rotation axis AX.

The third portions 311 are located in a manner engageable with the corresponding first portions 611. The fourth portions 312 are located in a manner engageable with the corresponding second portions 612.

Each first portion 611 includes a surface portion of the corresponding protrusion 61T on an attachment portion 61E of the spindle 61. Each third portion 311 includes an inner surface portion of the corresponding recess 31R on a ring 31A in the first cam 31.

In the present embodiment, each protrusion 61T has a first slope 61Td and a second slope 61Te. The first slope 61Td is inclined with respect to the radial direction about the rotation axis AX. The second slope 61Te is inclined with respect to the radial direction about the rotation axis AX. The second slope 61Te is inclined in a direction opposite to the first slope 61Td. The outer end of the first slope 61Td is connected to the outer end of the second slope 61Te. The outer end of the first slope 61Td and the outer end of the second slope 61Te form a corner 61Tf between them.

Each recess 31R has a contact surface 31Rd and a contact surface 31Re. The contact surface 31Rd is in contact with the first slope 61Td. The contact surface 31Re is in contact with the second slope 61Te.

As described above, each protrusion 61T may be triangular in a cross section orthogonal to the rotation axis AX.

Third Embodiment

A third embodiment will now be described. The same or corresponding components as those in the above embodiment are given the same reference numerals herein, and will be described briefly or will not be described.

Figure 22:
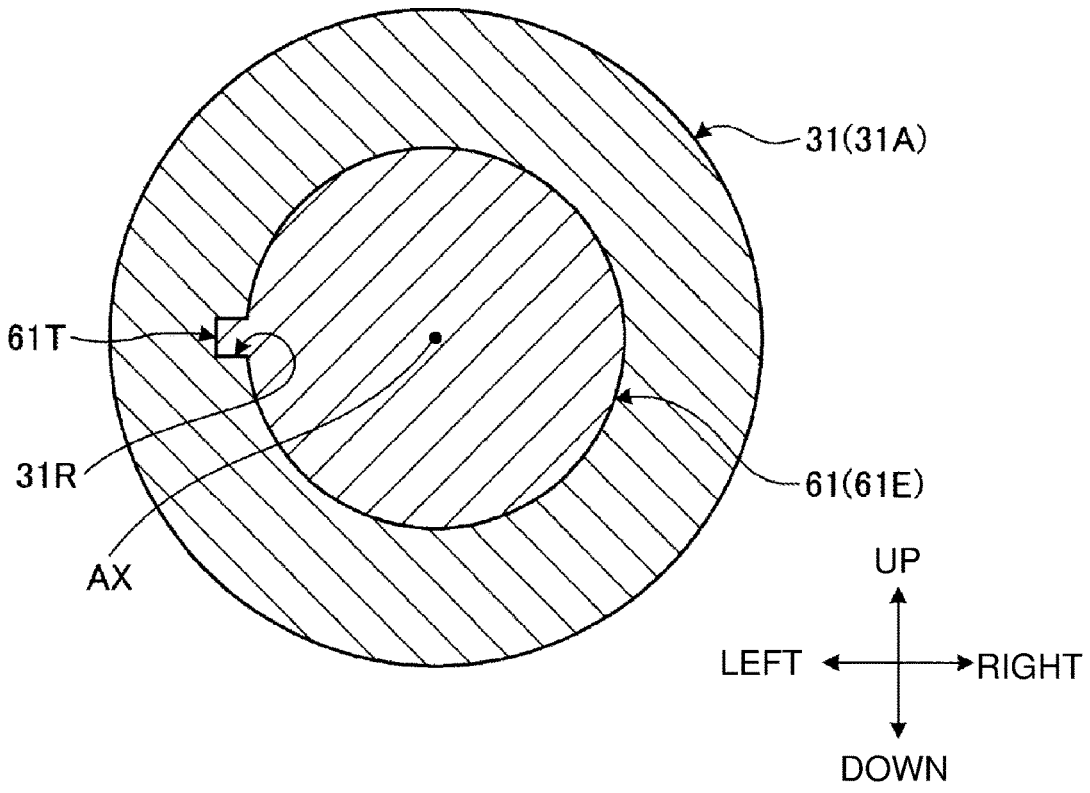
FIG. 22 is a cross-sectional view of a spindle and a first cam according to a third embodiment.

FIG. 22 is a cross-sectional view of a spindle 61 and a first cam 31 according to the present embodiment. As shown in FIG. 22, an attachment portion 61E of the spindle 61 includes a single protrusion 61T. A ring 31A in the first cam 31 has a single recess 31R.

In some embodiments, the attachment portion 61E may include two protrusions 61T. For example, the attachment portion 61E may include a first protrusion 61T on the left of the rotation axis AX and a second protrusion 61T on the right of the rotation axis AX in a cross section orthogonal to the rotation axis AX.

Fourth Embodiment

A fourth embodiment will now be described. The same or corresponding components as those in the above embodiment are given the same reference numerals herein, and will be described briefly or will not be described.

Figure 23:
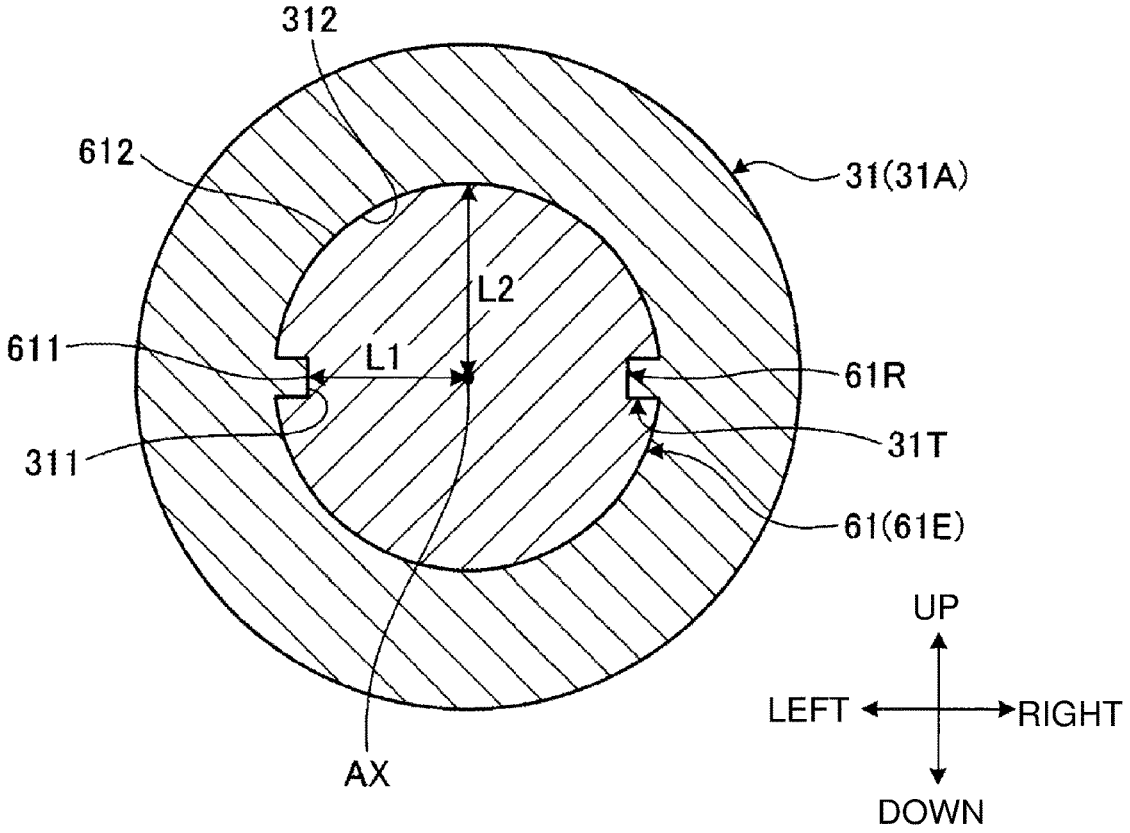
FIG. 23 is a cross-sectional view of a spindle and a first cam according to a fourth embodiment.

FIG. 23 is a cross-sectional view of a spindle 61 and a first cam 31 according to the present embodiment. As shown in FIG. 23, an attachment portion 61E of the spindle 61 includes first portions 611 and second portions 612 on its outer surface. In a cross section orthogonal to the rotation axis AX, a distance between the rotation axis AX and each first portion 611 is a first distance L1. In a cross section orthogonal to the rotation axis AX, a distance between the rotation axis AX and each second portion 612 is a second distance L2.

A ring 31A in the first cam 31 includes third portions 311 and fourth portions 312 on its inner surface. The third portions 311 are engaged with the first portions 611. The fourth portions 312 are engaged with the second portions 612.

In the present embodiment, the first distance L1 is shorter than the second distance L2. Each first portion 611 includes an inner surface portion of the corresponding recess 61R on the attachment portion 61E of the spindle 61. Each third portion 311 includes a surface portion of the corresponding protrusion 31T on the ring 31A in the first cam 31.

As described above, the attachment portion 61E of the spindle 61 may have the recesses 61R, and the ring 31A in the first cam 31 may include the protrusions 31T. As shown in FIG. 23, two recesses 61R may be used. In the example shown in FIG. 23, the attachment portion 61E includes a first recess 61R on the left of the rotation axis AX and a second recess 61R on the right of the rotation axis AX in a cross section orthogonal to the rotation axis AX. In some embodiments, a single recess 61R may be used, or three or more recesses 61R may be located circumferentially at intervals about the rotation axis AX. The recesses 61R may be located circumferentially at equal or unequal intervals about the rotation axis AX.

Fifth Embodiment

A fifth embodiment will now be described. The same or corresponding components as those in the above embodiment are given the same reference numerals herein, and will be described briefly or will not be described.

Figure 24:
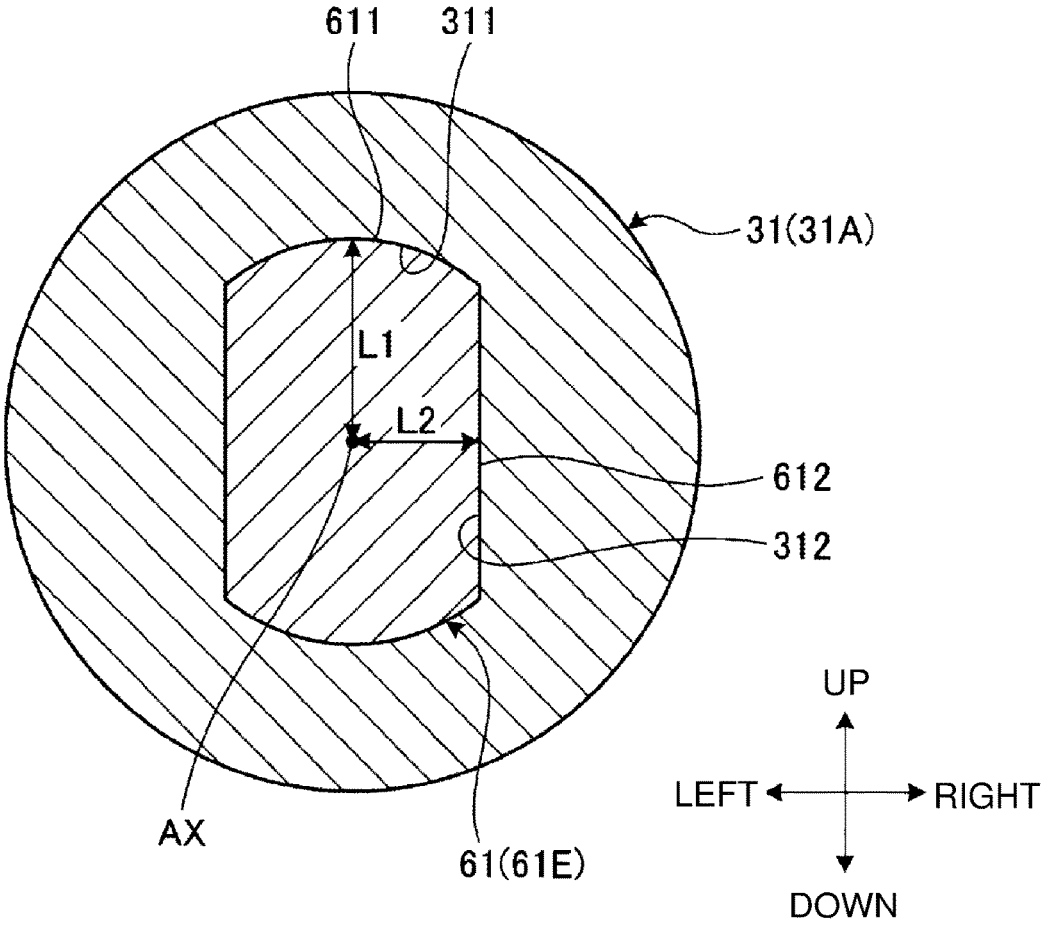
FIG. 24 is a cross-sectional view of a spindle and a first cam according to a fifth embodiment.

FIG. 24 is a cross-sectional view of a spindle 61 and a first cam 31 according to the present embodiment. As shown in FIG. 24, an attachment portion 61E of the spindle 61 includes first portions 611 and second portions 612 on its outer surface. In a cross section orthogonal to the rotation axis AX, a distance between the rotation axis AX and each first portion 611 is a first distance L1. In a cross section orthogonal to the rotation axis AX, a distance between the rotation axis AX and each second portion 612 is a second distance L2.

A ring 31A in the first cam 31 includes third portions 311 and fourth portions 312 on its inner surface. The third portions 311 are engaged with the first portions 611. The fourth portions 312 are engaged with the second portions 612.

The first portions 611 are arc-shaped in a cross section orthogonal to the rotation axis AX. The second portions 612 are straight in a cross section orthogonal to the rotation axis AX. In the example shown in FIG. 24, the first portions 611 are located above and below the rotation axis AX. The second portions 612 are located on the right and the left of the rotation axis AX.

As described above, the structure according to the present embodiment also reduces rotation of the spindle 61 relative to the first cam 31 in the vibration mode.

Sixth Embodiment

A sixth embodiment will now be described. The same or corresponding components as those in the above embodiment are given the same reference numerals herein, and will be described briefly or will not be described.

Figure 25:
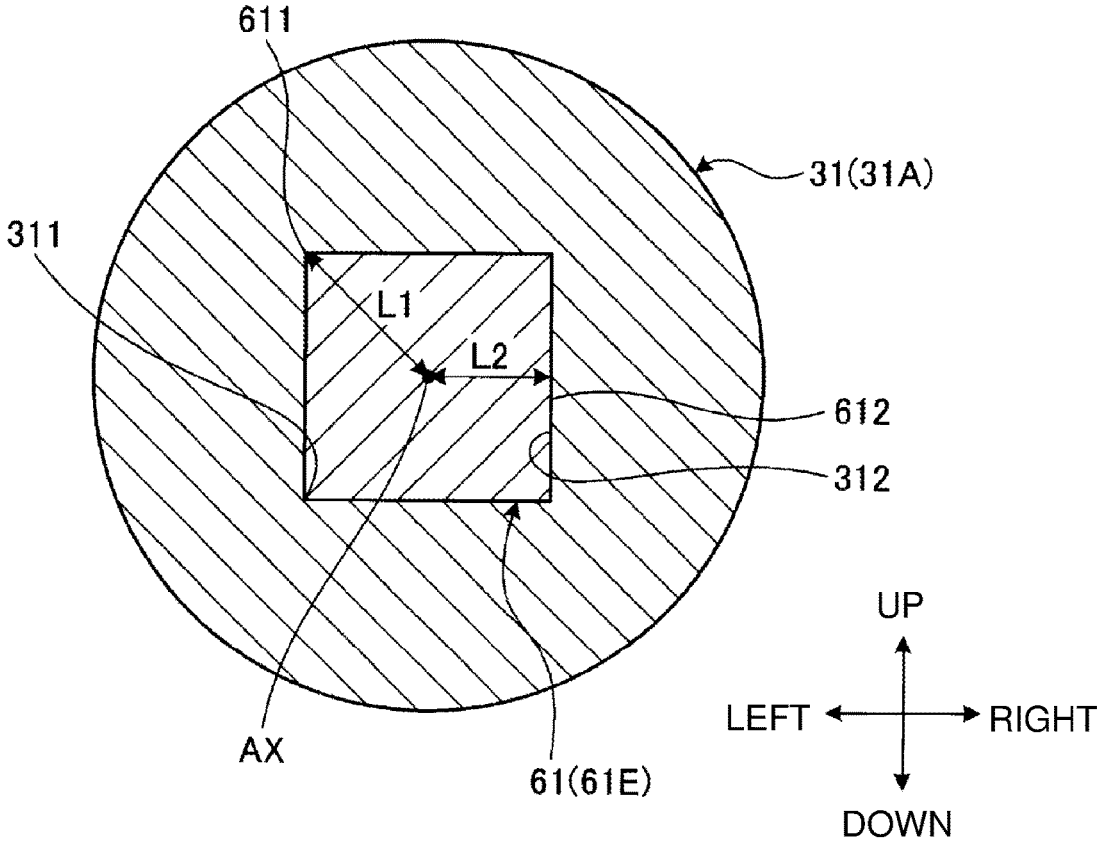
FIG. 25 is a cross-sectional view of a spindle and a first cam according to a sixth embodiment.

FIG. 25 is a cross-sectional view of a spindle 61 and a first cam 31 according to the present embodiment. As shown in FIG. 25, an attachment portion 61E of the spindle 61 includes first portions 611 and second portions 612 on its outer surface. In a cross section orthogonal to the rotation axis AX, a distance between the rotation axis AX and each first portion 611 is a first distance L1. In a cross section orthogonal to the rotation axis AX, a distance between the rotation axis AX and each second portion 612 is a second distance L2.

A ring 31A in the first cam 31 includes third portions 311 and fourth portions 312 on its inner surface. The third portions 311 are engaged with the first portions 611. The fourth portions 312 are engaged with the second portions 612.

The attachment portion 61E has a quadrangular profile in a cross section orthogonal to the rotation axis AX. The attachment portion 61E may have a square or rectangular profile. The first portions 611 are the corners of the quadrangle. The second portions 612 are the sides of the quadrangle. More specifically, the first portions 611 are angled in a cross section orthogonal to the rotation axis AX. The second portions 612 are straight in a cross section orthogonal to the rotation axis AX.

As described above, the structure according to the present embodiment also reduces rotation of the spindle 61 relative to the first cam 31 in the vibration mode.

In some embodiments, the second portions 612 may be curved in a cross section orthogonal to the rotation axis AX. The attachment portion 61E may have a triangular, pentagonal, or more polygonal profile in a cross section orthogonal to the rotation axis AX.

Seventh Embodiment

A seventh embodiment will now be described. The same or corresponding components as those in the above embodiment are given the same reference numerals herein, and will be described briefly or will not be described.

Figure 26:
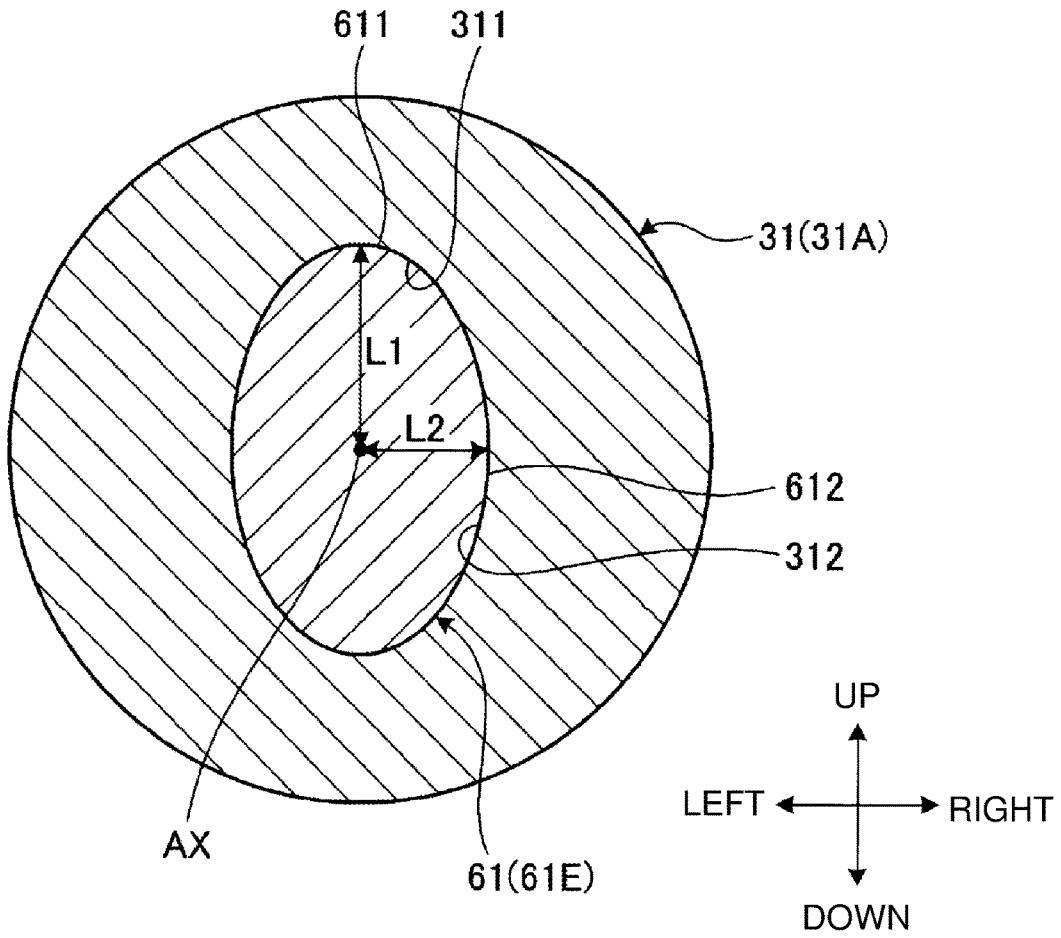
FIG. 26 is a cross-sectional view of a spindle and a first cam according to a seventh embodiment.

FIG. 26 is a cross-sectional view of a spindle 61 and a first cam 31 according to the present embodiment. As shown in FIG. 26, an attachment portion 61E of the spindle 61 includes first portions 611 and second portions 612 on its outer surface. In a cross section orthogonal to the rotation axis AX, a distance between the rotation axis AX and each first portion 611 is a first distance L1. In a cross section orthogonal to the rotation axis AX, a distance between the rotation axis AX and each second portion 612 is a second distance L2. A ring 31A in the first cam 31 includes third portions 311 and fourth portions 312 on its inner surface. The third portions 311 are engaged with the first portions 611. The fourth portions 312 are engaged with the second portions 612.

In the present embodiment, the attachment portion 61E has an elliptical profile in a cross section orthogonal to the rotation axis AX. The first portions 611 include parts of the attachment portion 61E intersecting with the major axis of the ellipse. The second portions 612 include parts of the attachment portion 61E intersecting with the minor axis of the ellipse. More specifically, the first portions 611 are curved in a cross section orthogonal to the rotation axis AX. The second portions 612 are curved in a cross section orthogonal to the rotation axis AX.

As described above, the structure according to the present embodiment also reduces rotation of the spindle 61 relative to the first cam 31 in the vibration mode.

In some embodiments, the second portions 612 may be curved in a cross section orthogonal to the rotation axis AX. The attachment portion 61E may have a triangular, pentagonal, or more polygonal profile in a cross section orthogonal to the rotation axis AX.

Eighth Embodiment

An eighth embodiment will now be described. The same or corresponding components as those in the above embodiment are given the same reference numerals herein, and will be described briefly or will not be described.

Figure 27:
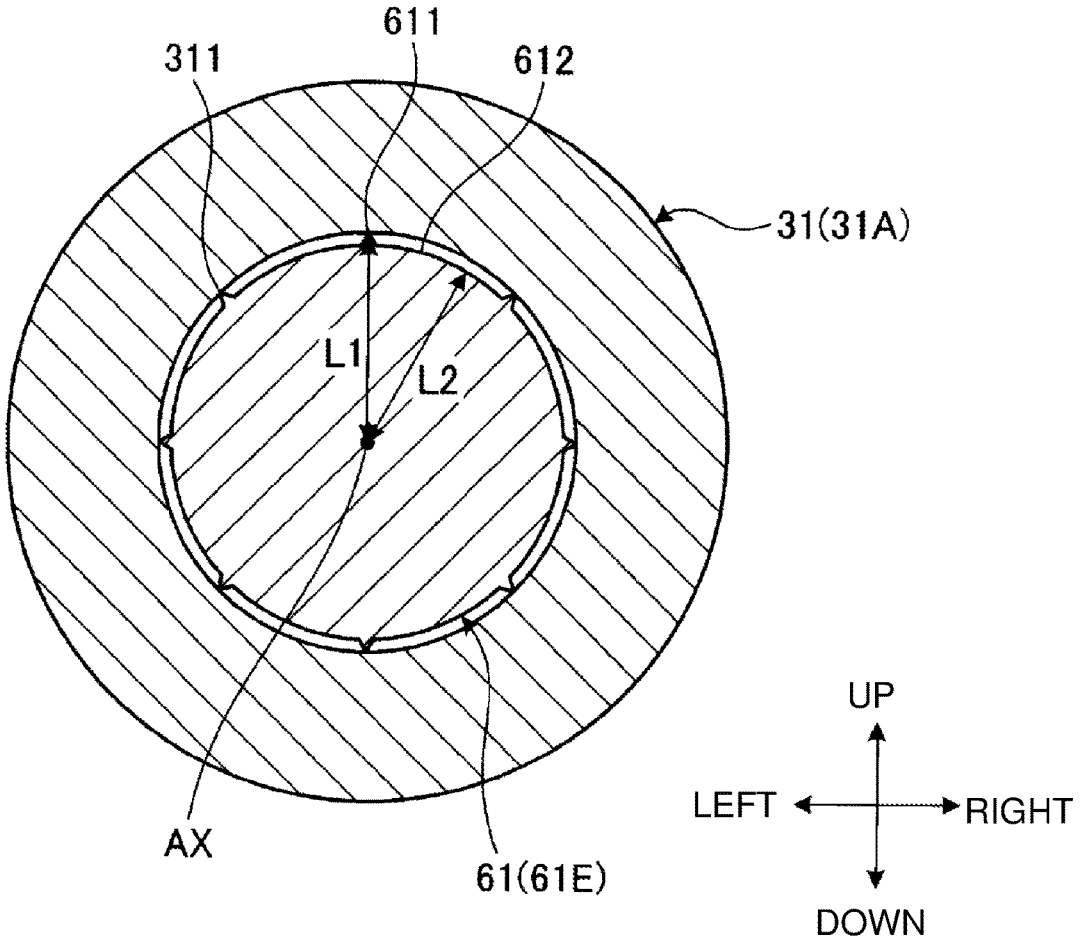
FIG. 27 is a cross-sectional view of a spindle and a first cam according to an eighth embodiment.

FIG. 27 is a cross-sectional view of a spindle 61 and a first cam 31 according to the present embodiment. As shown in FIG. 27, an attachment portion 61E of the spindle 61 includes first portions 611 and second portions 612 on its outer surface. In a cross section orthogonal to the rotation axis AX, a distance between the rotation axis AX and each first portion 611 is a first distance L1. In a cross section orthogonal to the rotation axis AX, a distance between the rotation axis AX and each second portion 612 is a second distance L2. Each first portion 611 includes a surface portion of the corresponding projection protruding radially outward from the outer surface of the attachment portion 61E of the spindle 61.

A ring 31A in the first cam 31 includes third portions 311 engaged with the first portions 611 on its inner surface. The inner surface of the ring 31A in the first cam 31 is circular in a cross section orthogonal to the rotation axis AX.

The first cam 31 is pressed onto the spindle 61 and fixed to the spindle 61. The first cam 31 is pressed onto the spindle 61 with the attachment portion 61E including the projections, and is firmly fixed to the spindle 61.

As described above, the structure according to the present embodiment also reduces rotation of the spindle 61 relative to the first cam 31 in the vibration mode.

Ninth Embodiment

A ninth embodiment will now be described. The same or corresponding components as those in the above embodiment are given the same reference numerals herein, and will be described briefly or will not be described.

Figure 28:
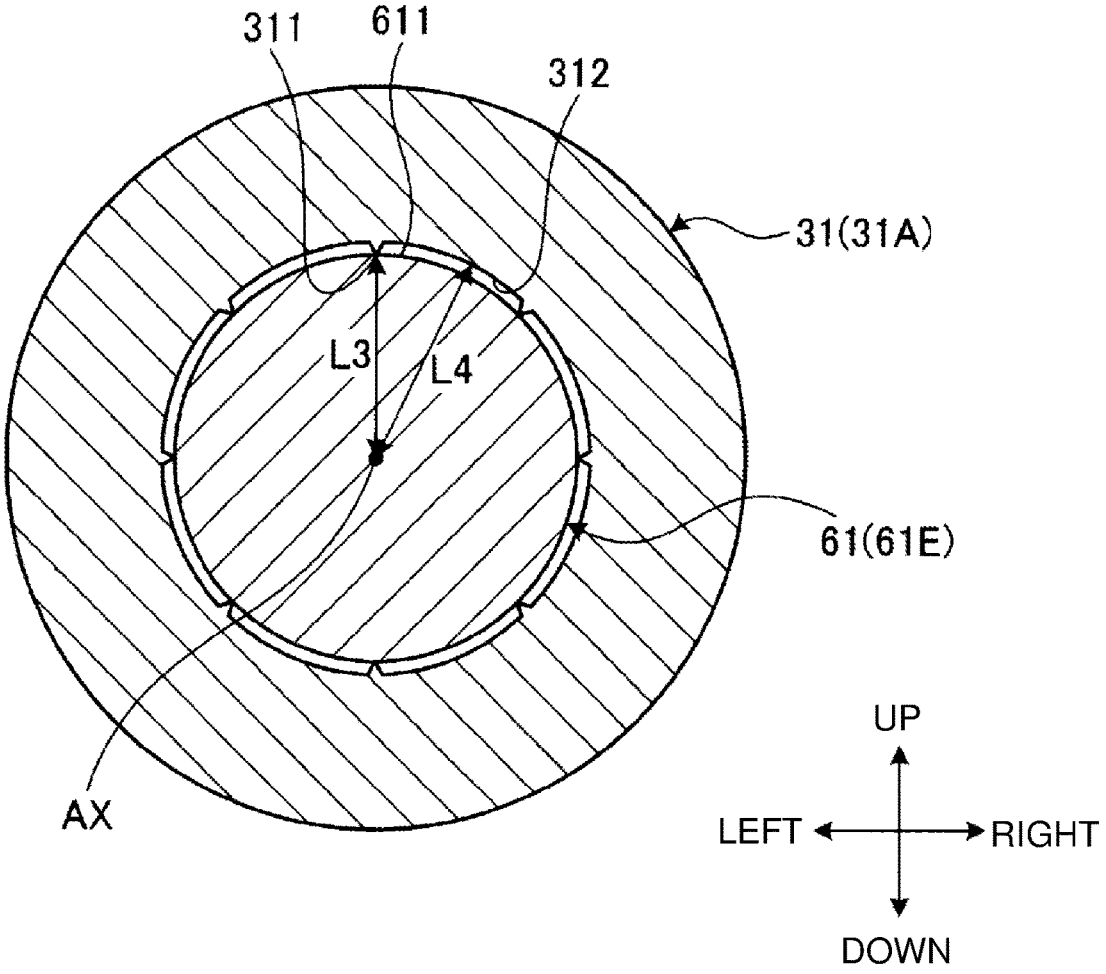
FIG. 28 is a cross-sectional view of a spindle and a first cam according to a ninth embodiment.

FIG. 28 is a cross-sectional view of a spindle 61 and a first cam 31 according to the present embodiment. As shown in FIG. 28, a ring 31A in the first cam 31 includes third portions 311 and fourth portions 312 on its inner surface. In a cross section orthogonal to the rotation axis AX, a distance between the rotation axis AX and each third portion 311 is a third distance L3. In a cross section orthogonal to the rotation axis AX, a distance between the rotation axis AX and each fourth portion 312 is a fourth distance L4. The fourth distance L4 is longer than the third distance L3. Each third portion 311 includes a surface portion of the corresponding projection protruding radially inward from the inner surface of the ring 31A in the first cam 31.

An attachment portion 61E of the spindle 61 includes first portions 611 engaged with the third portions 311 on its outer surface. The outer surface of the attachment portion 61E of the spindle 61 has a circular profile in a cross section orthogonal to the rotation axis AX.

The first cam 31 is pressed onto the spindle 61 and fixed to the spindle 61. The first cam 31 is pressed onto the spindle 61 with the ring 31A including the projections, and is firmly fixed to the spindle 61.

As described above, the structure according to the present embodiment also reduces rotation of the spindle 61 relative to the first cam 31 in the vibration mode.

Tenth Embodiment

A tenth embodiment will now be described. The same or corresponding components as those in the above embodiment are given the same reference numerals herein, and will be described briefly or will not be described.

Figure 29:
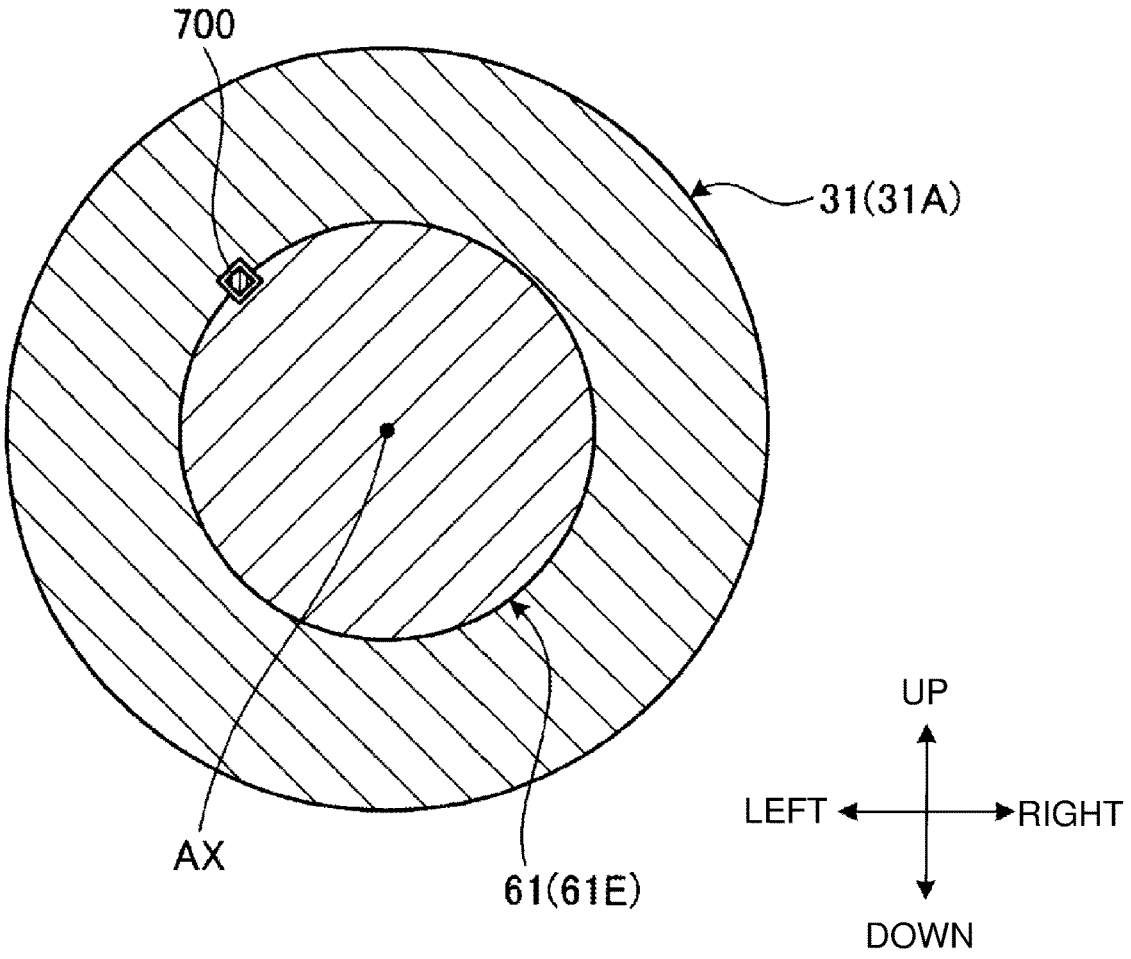
FIG. 29 is a cross-sectional view of a spindle and a first cam according to a tenth embodiment.

FIG. 29 is a cross-sectional view of a spindle 61 and a first cam 31 according to the present embodiment. As shown in FIG. 29, a ring 31A in the first cam 31 surrounds an attachment portion 61E of the spindle 61. The outer surface of the attachment portion 61E is substantially circular in a cross section orthogonal to the rotation axis AX. The inner surface of the ring 31A is substantially circular in a cross section orthogonal to the rotation axis AX.

In the present embodiment, an engagement member 700 is located between the spindle 61 and the first cam 31. A key is an example of the engagement member 700. A keyway for receiving the key is located on a part of the outer surface of the attachment portion 61E. The engagement member 700 is partially in contact with the inner surface of the ring 31A.

The engagement member 700 is not limited to a key. The engagement member 700 may be, for example, a pin. The engagement member 700 firmly fixes the first cam 31 to the spindle 61.

As described above, the structure according to the present embodiment also reduces rotation of the spindle 61 relative to the first cam 31 in the vibration mode.

What is claimed is:

1. A power tool, comprising:

a spindle configured to receive a tip tool and be rotatable about a rotation axis, the spindle having an outer surface including a first portion at a first distance from the rotation axis in a first cross section orthogonal to the rotation axis, and a second portion at a second distance from the rotation axis in the first cross section, the second distance being different from the first distance; and a vibration mechanism configured to vibrate the spindle in an axial direction, the vibration mechanism including a first cam (1) surrounding and fixedly attached to the spindle such that the first cam cannot rotate about the rotation axis relative to the spindle and (2) having an inner surface including a third portion firmly engaged with the first portion such that the first cam cannot rotate about the rotation axis relative to the spindle, and a fourth portion firmly engaged with the second portion such that the first cam cannot rotate about the rotation axis relative to the spindle, and a second cam (1) located behind the first cam and (2) configured to contact the first cam when the spindle moves along the axial direction in a direction away from the tip tool when the spindle receives the tip tool.

2. The power tool according to claim 1, wherein the spindle includes a plurality of the first portion located circumferentially at intervals about the rotation axis.

3. The power tool according to claim 2, wherein the plurality of the first portion is located circumferentially at equal intervals.

4. The power tool according to claim 1, wherein the first portion includes a surface portion of a protrusion of the spindle.

5. The power tool according to claim 1, wherein the second portion includes an inner surface portion of a recess of the spindle.

6. The power tool according to claim 1, wherein the first portion is arc-shaped in the first cross section, and the second portion is straight in the first cross section.

7. The power tool according to claim 1, wherein the first portion is angled in the first cross section.

8. The power tool according to claim 1, wherein the first portion is curved in the first cross section, and the second portion is curved in the first cross section.

9. The power tool according to claim 1, further comprising;

a clutch switch ring; and a spring holder configured to move in a front-rear direction with respect to the clutch switch ring;

wherein the clutch switch ring and the spring holder overlap the first cam in a cross sectional plane.

10. The power tool according to claim 1, further comprising:

a vibration switch lever configured to switch a rotatable state or a non-rotatable state of the second cam, the vibration switch lever overlaps the first cam in a cross sectional plane.

11. The power tool according to claim 2, wherein the first portion includes a surface portion of a protrusion of the spindle.

12. The power tool according to claim 3, wherein the first portion includes a surface portion of a protrusion of the spindle.

13. The power tool according to claim 2, wherein the second portion includes an inner surface portion of a recess of the spindle.

14. The power tool according to claim 3, wherein the second portion includes an inner surface portion of a recess of the spindle.

15. The power tool according to claim 4, wherein the second portion includes an inner surface portion of a recess of the spindle.

16. The power tool according to claim 1, wherein the third portion is a third distance from the rotation axis in the first cross section, and the fourth portion is a fourth distance from the rotation axis in the first cross section, the fourth distance being different from the third distance.

17. The power tool according to claim 16, wherein the spindle has an outer surface including a first portion engaged with the third portion.

* * * * *